US010253474B2

(12) United States Patent
Allard

(10) Patent No.: US 10,253,474 B2
(45) Date of Patent: Apr. 9, 2019

(54) APPARATUSES AND METHODS FOR FIBER ROLLS

(71) Applicant: Douglas Paul Allard, Santa Rosa, CA (US)

(72) Inventor: Douglas Paul Allard, Santa Rosa, CA (US)

( * ) Notice: Subject to any disclaimer, the term of this patent is extended or adjusted under 35 U.S.C. 154(b) by 0 days.

(21) Appl. No.: 15/410,672

(22) Filed: Jan. 19, 2017

(65) Prior Publication Data

US 2017/0204582 A1 Jul. 20, 2017

Related U.S. Application Data

(60) Provisional application No. 62/281,075, filed on Jan. 20, 2016.

(51) Int. Cl.
*E02B 3/12* (2006.01)
*E02D 17/20* (2006.01)

(52) U.S. Cl.
CPC ..... *E02D 17/202* (2013.01); *E02B 3/125* (2013.01); *E02D 17/205* (2013.01); *E02D 2200/1685* (2013.01); *E02D 2300/00* (2013.01); *E02D 2300/0006* (2013.01); *E02D 2600/30* (2013.01)

(58) Field of Classification Search
CPC ..... E02B 3/125; E02B 3/127; E02D 17/202; E02D 17/205
See application file for complete search history.

(56) References Cited

U.S. PATENT DOCUMENTS 3,708,146 A * 1/1973 Lamberton ..... E02D 5/60 249/1
4,650,368 A * 3/1987 Bayer ..... E02B 3/127 383/102
5,059,065 A * 10/1991 Doolaege ..... E02B 3/127 405/107
5,158,395 A * 10/1992 Holmberg ..... E02B 3/127 405/15
5,338,131 A * 8/1994 Bestmann ..... E02B 3/12 405/24
5,562,364 A * 10/1996 Darder-Alomar ..... E01F 15/0469 405/215
5,595,458 A * 1/1997 Grabhorn ..... E02B 3/125 405/302.6
5,605,416 A * 2/1997 Roach ..... E02B 3/02 405/21
5,830,281 A * 11/1998 Kliewer ..... A47L 13/16 134/6

(Continued)

FOREIGN PATENT DOCUMENTS

DE 19923069 A1 * 1/2000 ..... E02B 3/127

OTHER PUBLICATIONS

"Quick Garden HALO" Quick Garden website, available at http://quickgarden.ca/product/quick-garden-halo/, listed print date Feb. 27, 2017 (2 pages).

(Continued)

*Primary Examiner* — Frederick L Lagman

(57) ABSTRACT

The invention provides components, structures, methods, and assemblies for controlling sedimentation and debris flow associated with soil erosion. The invention also provides components, structures, methods, and assemblies that are useful for anchoring fiber rolls along a sloped surface.

17 Claims, 25 Drawing Sheets

(56) References Cited

U.S. PATENT DOCUMENTS 6,422,787 B1 * 7/2002 Mikell ..... E02B 3/126 405/15
6,527,477 B1 3/2003 Allard
6,547,493 B2 4/2003 Spangler et al.
6,641,335 B1 11/2003 Allard
6,733,209 B2 5/2004 Allard
6,857,818 B2 * 2/2005 Bussey, Jr. ..... E02B 11/005 405/36
6,893,193 B2 5/2005 Santha
6,913,423 B2 * 7/2005 Spangler ..... E02B 3/04 405/302.6
6,991,408 B2 * 1/2006 Bottriell ..... E02B 11/005 405/302.7
7,029,208 B1 4/2006 Santha
7,303,084 B2 * 12/2007 McPhillips ..... A01N 25/08 210/501
7,449,105 B2 * 11/2008 Hastings ..... E02D 29/0291 210/170.03
7,811,028 B1 * 10/2010 de la Rosa ..... E02B 3/04 405/15
8,070,387 B2 12/2011 Schaaf
8,821,076 B2 * 9/2014 Tyler ..... B65B 1/04 405/19
9,562,350 B1 * 2/2017 Witt ..... B01D 29/012
2002/0159845 A1 * 10/2002 Mikell ..... E02B 3/126 405/302.6
2004/0146359 A1 * 7/2004 Doolaege ..... E02B 3/108 405/115
2006/0032804 A1 * 2/2006 McPhillips ..... A01N 25/08 210/205
2007/0003369 A1 1/2007 Hanson et al.
2008/0131212 A1 6/2008 Quinley et al.
2010/0003081 A1 * 1/2010 Doolaege ..... E02B 3/108 405/115
2010/0036334 A1 * 2/2010 Heagle ..... A61F 13/02 604/319
2010/0133168 A1 * 6/2010 Jacobsen ..... E02B 3/04 210/455
2010/0150656 A1 * 6/2010 Feldman ..... E02B 3/06 405/111
2012/0141730 A1 * 6/2012 Toye ..... A01G 13/0268 428/136
2014/0050527 A1 2/2014 Kelsey et al.
2015/0132060 A1 * 5/2015 Stehling ..... A01G 13/0256 405/15

OTHER PUBLICATIONS

"GatorGard Product Overview—Gator Guard," http://gatorguard.com/product-overview/, listed print date: Dec. 1, 2015 (1 page).
GatorGuard Environmental Products Inc., "Sediment Control Wattles," http://gatorguard.com/sediment-control-wattles/, listed print date: Feb. 27, 2017 (5 pages).

* cited by examiner

APPARATUSES AND METHODS FOR FIBER ROLLS

CROSS-REFERENCE TO RELATED APPLICATIONS

This application claims the benefit of U.S. Provisional Application No. 62/281,075 filed on Jan. 20, 2016, the subject matter of which is herein incorporated by reference in its entirety.

FIELD OF THE INVENTION

The present invention relates to erosion control and more particularly to components, apparatuses, and methods for use in controlling sedimentation and debris flow associated with soil erosion.

BACKGROUND OF THE INVENTION

Fiber rolls, also known as straw wattles, wattles, erosion control rolls, fiber logs, or sediment logs, are a well-known best management practice (BMP) for controlling sediment and erosion caused by storm water runoff. Typically, fiber rolls are tube-shaped structures filled with biodegradable fibrous material, such as straw, rice, flax, coconut fiber material (coir), excelsior (shredded wood), or composted material. The fiber rolls may be wrapped and held together with geotextile fabric, such as burlap, jute, or coir, or UV degradable plastic netting. Fiber rolls can be used in a variety of sloped settings to reduce the erosion effects of long or steep slopes in a variety of landscaped sites.

Fiber rolls are designed to allow for water flow, while filtering and capturing sediments and debris. In so doing, fiber rolls may be used to direct and/or slow water velocity and diffuse overflows, thereby reducing rill and other types of erosion that may occur with uninterrupted water flow down a sloped surface. They also help to trap and settle out sediments, thereby keeping soil onsite and reducing sediment loads to storm drain systems and receiving waters. Additionally, fiber rolls may capture seeds present in stormwater and allow the seeds to settle and germinate. In this way, fiber rolls may promote the growth of plants and natural vegetation.

Historically, silt fences have been used as an alternate method of controlling erosion along slopes. Silt fences are generally constructed of black porous cloth (e.g., geotextile cloth) strung vertically on wooden stakes across a slope to capture sediment. As known in the art, silt fences are usually labor intensive to install and remove. They also may be discouraged because of the propensity for silt fences to collapse and fail, for instance when they encounter high fluid flow or high winds.

Fiber rolls have been found to be an effective alternative erosion control solution. They may be installed in projects with slopes, minimal slopes, or on flat ground to keep sediment from washing onto landscaped areas, such as sidewalks or streets, and into storm drains. For example, fiber rolls may be placed around storm drains to reduce the effects of sediment pollution. They may also be placed along sidewalks to prevent sediment from washing into gutters.

Proper installation of fiber rolls, however, is needed to ensure effective slope protection. In a typical installation along a hill, multiple fiber rolls may be placed in rows substantially perpendicularly to the slope; in effect, shortening the slope length. The vertical spacing of each row is dependent on the slope gradient. Wooden stakes typically are driven through the fiber roll, for example, perpendicular to the slope face, to secure the fiber roll. In an alternate installation, the conventional stakes are placed to the side of each fiber roll, and one or more ropes may be secured to the stakes to secure the rolls. For example, one or more ropes may be interwoven between alternating stakes placed above and below the fiber rolls. The resulting system of fiber rolls is designed to reduce soil erosion and to dam, direct, and/or filter stormwater flowing down the slope.

When more than one fiber rolls are placed end-to-end in a row, there is the possibility of focused water and sediment leakage at the abutments. Gaps at the ends of adjacent rolls may provide a focused pathway for runoff to concentrate, which can accelerate erosion. For this reason, some regulatory agencies require that the ends of adjacent fiber rolls tightly abut or overlap. For instance, the end of a fiber roll may be overlapped over the end of an adjacent fiber roll to minimize the water velocity at the ends of the rolls. The amount of overlap depends on the requirements of a particular site and/or agency. As an example, a particular site may require that the end of each erosion control roll overlap with one to three feet of the adjacent roll.

This configuration requires additional material in the form of additional fiber roll length needed for a given site. It may often involve additional labor to secure the ends of each fiber roll, either to ensure a firm abutment or to create a sufficient overlap to minimize leakage at the ends. The configuration may also require additional labor to adequately secure overlapped fiber rolls to the sloped surface. It can also increase the costs for installing fiber rolls on a particular site.

In addition, when installing fiber rolls using conventional stakes, the stakes must be positioned and driven into the ground with care so that the stakes are sufficiently driven through the fiber roll to secure the roll in place but are not broken in the process. In some instances, heavy sediment loads could pull the fiber roll off the stake if the stake is driven down too low. Moreover, conventional stakes are usually driven through the fiber rolls and into the ground, with the top of portion of the stake remaining exposed. The exposed stake ends pose a potential safety hazard, particularly in areas with or near foot traffic, such as sidewalks and parking lots.

While many current regulations allow biodegradable fiber rolls, such as those made of straw and covered in burlap material, to be left in place after construction activities have been completed, the stakes must be removed as they may create a safety hazard to ongoing landscape maintenance operations. The use of conventional stakes in these applications thus requires additional time, labor, and resources for maintenance during construction and removal after construction. It can also increase the costs for maintaining and removing fiber rolls on a particular site.

Given their size and above ground positioning along a slope or ground surface, fiber rolls may create an obstruction on the ground surface. As such, they may present a potential safety hazard in construction sites and other landscaped areas, particularly in areas subject to heavy foot traffic.

Accordingly, there exists a need for more effective devices and systems for controlling erosion, including a need for improvements in safely and efficiently installing fiber rolls in landscaped areas.

BRIEF SUMMARY OF THE INVENTION

The present invention is directed generally to improved assemblies and methods for erosion and sediment control.

The present invention provides an apparatus comprising an elongated body member comprising two flexible side pieces; complementary closures disposed along a portion of the side pieces; and a fastener disposed along an interior of the body member. The side pieces of the body member are adapted to fit around one or more fiber rolls. The complementary closures are adapted to connect the side pieces of the body member. The fastener is adapted to connect the body member around one or more fiber rolls. One or more optional apron members may extend from an exterior surface of the body member. The apparatus may further comprise a hoop disposed along an exterior portion of the body member and an installation pin driven through the hoop. In a preferred embodiment, the hoop and fastener comprise a unitary structure.

In some embodiments, the elongated body member may be adapted to fit around an end portion of a first fiber roll and an end portion of a second fiber roll to couple the first and second fiber rolls. The elongated body member may be adapted to be positioned at intervals along joints of a fiber roll assembly. The elongated body member may be adapted to be positioned along a single fiber roll.

The complementary closures on the side pieces of the body member may comprise one or more hook-and-loop fasteners, strings, snaps, staples, or zippers. The fastener disposed along an interior of the body member may comprise a tie-down string. The apparatus may be constructed of biodegradable burlap material or UV degradable polypropylene material. The elongated body member may comprise a high visibility color. The apparatus may further comprise reflective material disposed along a length of the body member. In some embodiments, the apparatus may comprise one or more light fixtures disposed along an exterior of the body member. When the elongated body member is used with an installation pin, the installation pin may comprise a hooked-structure selected from the group consisting of a pin with a U-shaped hook, a pin with a triangle-shaped hook, and a pin with a diamond-shaped hook.

In other embodiments, the elongated body member may comprise an interior space, and the interior space defines a substantially tubular or a substantially cuboidal opening. It may be adapted to fit around a segment of a single fiber roll.

The present invention also provides an apparatus comprising an elongated casing comprising a first open end, a second open end, and an interior cavity. The first and second open ends of the elongated casing are dimensioned to fit around one or more fiber rolls. The elongated casing may further comprise a first coupler around the first open end, and the first open end of the body member may be adapted to attach to a fiber roll via the first coupler. The elongated casing may also comprise a second coupler around the second open end, and the second open end of the elongated casing may be adapted to attach to a fiber roll via the second coupler. The first and second couplers may comprise drawstrings. In a preferred embodiment, the apparatus comprises an apron extending from the elongated casing along a length of the casing.

The present invention further provides an erosion control apparatus comprising a fiber roll formed from one or more materials selected from the group consisting of excelsior, straw, and a porous foam material, the fiber roll comprising a lateral surface and an end region. The apparatus also comprises an elongated casing surrounding the lateral surface of the fiber roll along the end region. The elongated casing comprises a coupling segment that extends past the end region of the fiber roll, and the coupling segment is adapted to fit around an end region of an adjacent fiber roll. In some embodiments, the elongated casing may be attached to the elongated fiber roll (e.g., by sewing) in an integrated structure. The apparatus may also comprise one or more sheets of material extending from one or more lateral surfaces of the casing to define a filter apron. The coupling segment may be capable of forming a connection with an adjacent fiber roll, and it comprises a coupler (e.g., a drawstring) that is capable of forming a connection with an adjacent fiber roll.

In other embodiments, the present invention provides a method of controlling soil erosion along a slope comprising the steps of: positioning a fiber roll member along a sloped area and positioning a fiber roll over the fiber roll member. The fiber roll member comprises an elongated body member comprising two flexible side pieces, complementary closures disposed along the side pieces of the body member, and a fastener disposed in the interior of the body member. The method further comprises the steps of connecting the body member to one or more fiber rolls using the fastener; fitting the side pieces of the body member around one or more fiber rolls; and connecting the side pieces of the body member using the complementary closures.

In yet other embodiments, the present invention provides a method of controlling soil erosion along a slope comprising the steps of: providing a first fiber roll along a surface; providing an elongated casing comprising a first open end, a second open end, and an interior cavity; and fitting the first and second open ends of the elongated casing around the fiber roll.

In another embodiments, the present invention provides a method of controlling soil erosion along a slope comprising the steps of: positioning a fiber roll unit comprising a first fiber roll and an elongated casing surrounding the lateral surface of the fiber roll; positioning a second fiber roll adjacent to the first end region of the first fiber roll; fitting the coupling segment of the elongated casing around the second end region of the second fiber roll to couple the first fiber roll to the second fiber roll; and securing the coupling segment of the elongated casing around the second end region of the second fiber roll using a coupling member.

The present invention further provides an apparatus for use in anchoring a fiber roll comprising: a tapered base member; and an extendable attachment member disposed along an upper portion of the base member. In particular embodiments, the attachment member is dimensioned to attach to an outside surface of a fiber roll. The attachment member may comprise one or more strings and/or pieces of twine. The attachment member may be stapled to the base member. The attachment member may be dimensioned to wrap around an outside surface of a fiber roll.

In some embodiments, the base member comprises a metal spike, wood stake, a pin with a U-shaped hook, a pin with a triangle-shaped hook, and/or a pin with a diamond-shaped hook. The base member may comprise a protruding tab, and the attachment member is secured under the protruding tab. Alternatively, the base member may comprise a recessed area, and the attachment member is secured through the recessed area. The base member may comprise a shelf adapted to support a fiber roll.

In some embodiments, the base member may comprise a pin and disc-shaped plate. The disc-shaped plate may comprise an opening along a top surface, and the attachment member is dimensioned to fit through the opening of the disc-shaped plate.

The present invention also provides an anchoring system for a fiber roll comprising: a post comprising a substantially flat top surface adapted to support a fiber roll and an end portion that tapers toward a point; a fiber roll disposed on the top surface of the post; and a string disposed along an upper portion of the post, wherein the string is dimensioned to be wrapped around the fiber roll.

The present invention also provides a method of anchoring a fiber roll to a ground surface comprising the step of providing an anchoring apparatus. The anchoring apparatus comprises a tapered base member; and an attachment member disposed along an upper portion of the base member, wherein the attachment member is dimensioned to attach to an outside surface of a fiber roll. The method further comprises the steps of driving the tapered base member of the anchoring apparatus into a ground surface; and securing the attachment member around a fiber roll.

BRIEF DESCRIPTION OF THE DRAWINGS

Embodiments of the present invention may be described with reference to the accompanying drawings.

DETAILED DESCRIPTION OF THE INVENTION

Figure 1:
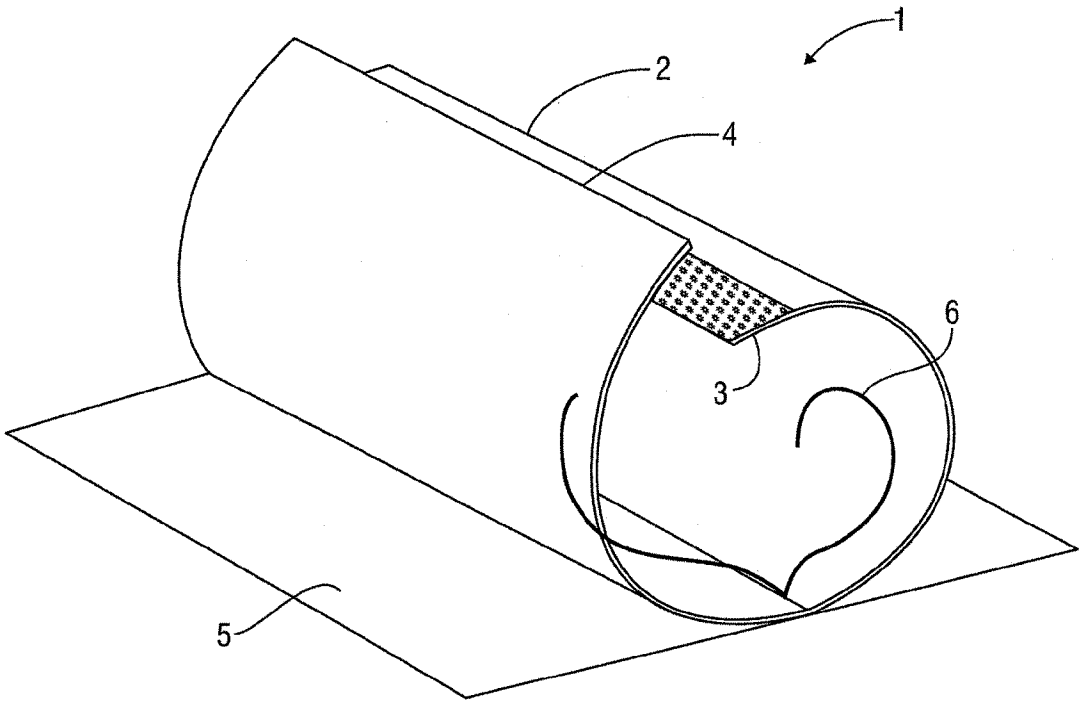
FIG. 1 illustrates schematically an angled side view of a fiber roll sleeve with an open top, according to one embodiment of the present invention. The sleeve comprises a tie-down string that is sewn into the hem.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the terms "a" or "an" are employed to describe elements and components of the invention. This is done merely for convenience and to give a general sense of the invention. This description should be read to include one or at least one, and the singular also includes the plural unless it is obvious that it is meant otherwise.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more embodiments.

Unless otherwise defined, all technical and scientific terms used herein have the same meaning as commonly understood by one of ordinary skill in the art to which this invention belongs. Although methods similar or equivalent to those described herein can be used in the practice or testing of the present invention, suitable methods and materials are described herein. All publications, patent applications, patents, and other references mentioned herein are incorporated by reference in their entirety. In case of conflict, the present specification, including definitions, will control. In addition, the materials, methods, and examples are illustrative only and not intended to be limiting.

In the following description, numerous specific details are provided, such as the identification of various system components, to provide an understanding of embodiments of the invention. One skilled in the art will recognize, however, that embodiments of the invention can be practiced without one or more of the specific details, or with other methods, components, materials, etc. In still other instances, well-known structures, materials, or operations are not shown or described in detail to avoid obscuring aspects of various embodiments of the invention.

I. Fiber Roll Sleeves

The present invention is directed to fiber roll apparatuses, components, and methods for use in controlling stormwater, sedimentation, and debris flow. The present invention is particularly useful for installing fiber rolls on a variety of sloped surfaces, flat surfaces, construction sites, agricultural areas, stream banks, and other areas where erosion poses environmental concerns.

In some embodiments, the present invention provides for an elongated fiber roll member that helps to overcome or reduce some or all of the limitations of the prior art. The fiber roll member can be placed anywhere along the length of one or more fiber rolls; for example, along the body of a fiber roll, at end portions of a fiber roll, or at intervals along joints of a fiber roll assembly. The fiber roll member may form part of a fiber roll. For example, the fiber roll member may be formed as part of the fiber roll during fabrication and form a unitary structure with the fiber roll. The fiber roll member may alternatively be one or more separate pieces that are installed to help secure or couple fiber rolls (e.g., at a construction site) or enhance the visibility of fiber rolls (e.g., as a colored sleeve or cuff) after the fiber rolls have been fabricated.

As will be discussed in more detail in the below examples, the fiber roll member may be designed to help secure the fiber roll in place. It may also help to impede the flow of sediments and allow for water flow through the fiber roll member, for example, down a sloped surface. It may also be useful in directing, slowing water velocity, and spreading overflows, while minimizing the focused flow of water between adjacent fiber rolls. The fiber roll member may also be used as a joint connector or anywhere along a fiber roll as a "safety sleeve" for safety purposes (e.g., to enhance visibility, provide instructions for use, and/or provide other markers or identification for the fiber rolls in heavy traffic areas).

A. Sleeves with Open Top

In one embodiment, the fiber roll member may be an open-top sleeve designed to complement the shape of one or more standard fiber rolls. A sleeve may be formed from one or more flexible sheets of material with two loose sections of material that may be wrapped around one or more fiber rolls. The loose sections of material form an open top portion with one or more re-sealable top closures along the top portion. The re-sealable top closure facilitates installation, removal, and/or reinstallation of the sleeve.

Referring to the example in FIG. 1, sleeve 1 includes a body portion with an open top 2. The sleeve also includes a hollow interior and open portions at the ends. Opposite sections of the body portion may be connected to form a tubular casing and fitted around a tube-shaped fiber roll. The body portion includes with one or more connection devices that can be used to connect the loose sections of the body portion. As an example, one or more complementary strips of Velcro or other types of hook-and-loop fasteners 3 and 4 may be used to connect opposite sections of the body portion.

As shown in this example, the sleeve may be formed from two substantially rectangular pieces of fabric that are stacked and sewn lengthwise along the approximate center of the fabric to form loose sections of material. The loose sections from one piece of material can wrap around a tube-shaped fiber roll. In practice, however, the sleeve and the material used to form the sleeve may take one of any known shapes capable of fitting around all of at least a portion of a fiber roll (e.g., substantially circular, substantially round, substantially triangular, or irregularly shaped).

The sleeve also includes one or more optional apron portions 5. The apron portion may take the form of a flap or a wide hem that extends past an edge of the body portion and helps to secure the sleeve to the ground or other surface. The apron portion may be located on different sides of the fiber roll sleeve; for example, for a sleeve used on slope, apron portions may be located on both the upslope and downslope sides of the sleeve. As an added feature, the apron portion may also help to retain sediments and prevent erosion along the length of the fiber roll.

One or more optional inner tie-down strings 6 may be sewn onto the hem of the fabric. For example, two tie-down strings may be sewn along the inner hem near opposite ends of the sleeve. Alternatively, a single tie-down string may be sewn along the inner hem along a center portion of the sleeve. In yet other embodiments, such as for those applications where a simple sleeve or cuff is needed for identification or safety purposes, the fiber roll sleeve without an inner tie-down string may be fitted around a fiber roll.

The sleeve may also include one or more hoops (as shown in FIG. 3A) attached at the base of the sleeve. The hoop is useful for securing the sleeve to the ground using metal or plastic installation pins that are placed through the hoop and into the ground. In one embodiment, a hoop is formed from string and sewn into the bottom hem. In a preferred embodiment, the hoop is formed within and integral to an inner tie-down string to allow the fiber roll sleeve to be securely connected to the ground. That is, the inner tie-down string extends through the hem of the sleeve, forming a hoop that allows the inner string to be connected directly to the ground. In other embodiments, hoops may be formed from separate pieces of string. The hoop may be located near a center portion of the sleeve base (as shown in FIG. 3A) or anywhere else on the base of the sleeve to provide a secure connection point to the ground; for example, at the four corners of the fabric sleeve.

Figure 2:
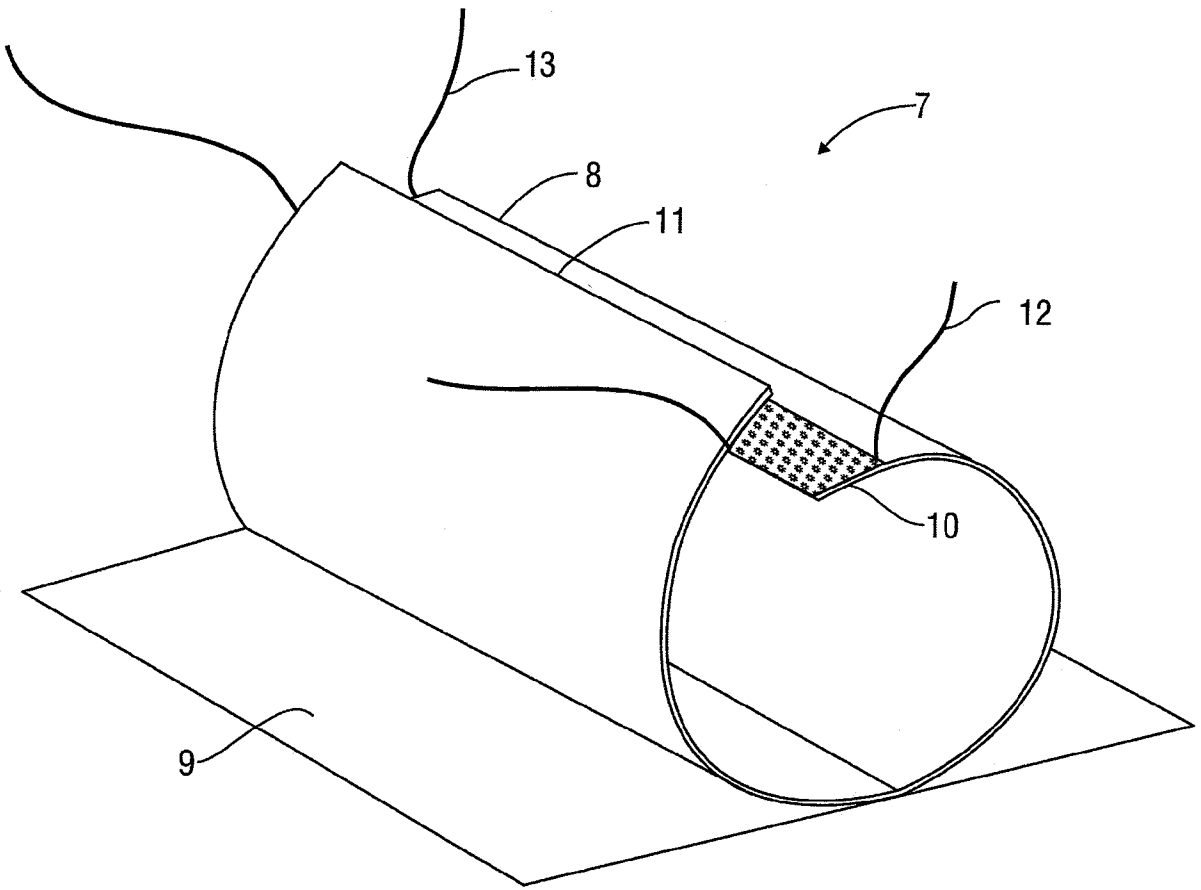
FIG. 2 illustrates schematically an angled side view of a fiber roll sleeve with an open top, according to another embodiment of the present invention. The sleeve comprises a drawstring located at each of the loose ends of the sleeve.

In an alternate configuration, an open top sleeve may also use one or more drawstrings to help secure the wattle. Referring to FIG. 2, sleeve 7 includes a body portion with an open top 8. The sleeve includes a hollow interior and open portions at the ends. The sleeve also includes one or more apron portions 9. Opposite sections of the body portion may be connected along a length of the body portion to form a tubular casing and fitted around a tube-shaped fiber roll. The body portion includes with one or more connection devices that are used to connect opposite sections from the body portion; for example, one or more complementary strips of Velcro or other types of hook-and-loop fasteners 10 and 11. Strings 12 and 13 are placed at each end. The strings may be pulled around a fiber roll to secure the roll in place. In a preferred embodiment, two drawstrings may loop through the base of the sleeve to form two hoops on the underside of the sleeve (not shown), one from each drawstring. The hoops can be used to secure the sleeve to the ground.

Figure 3:
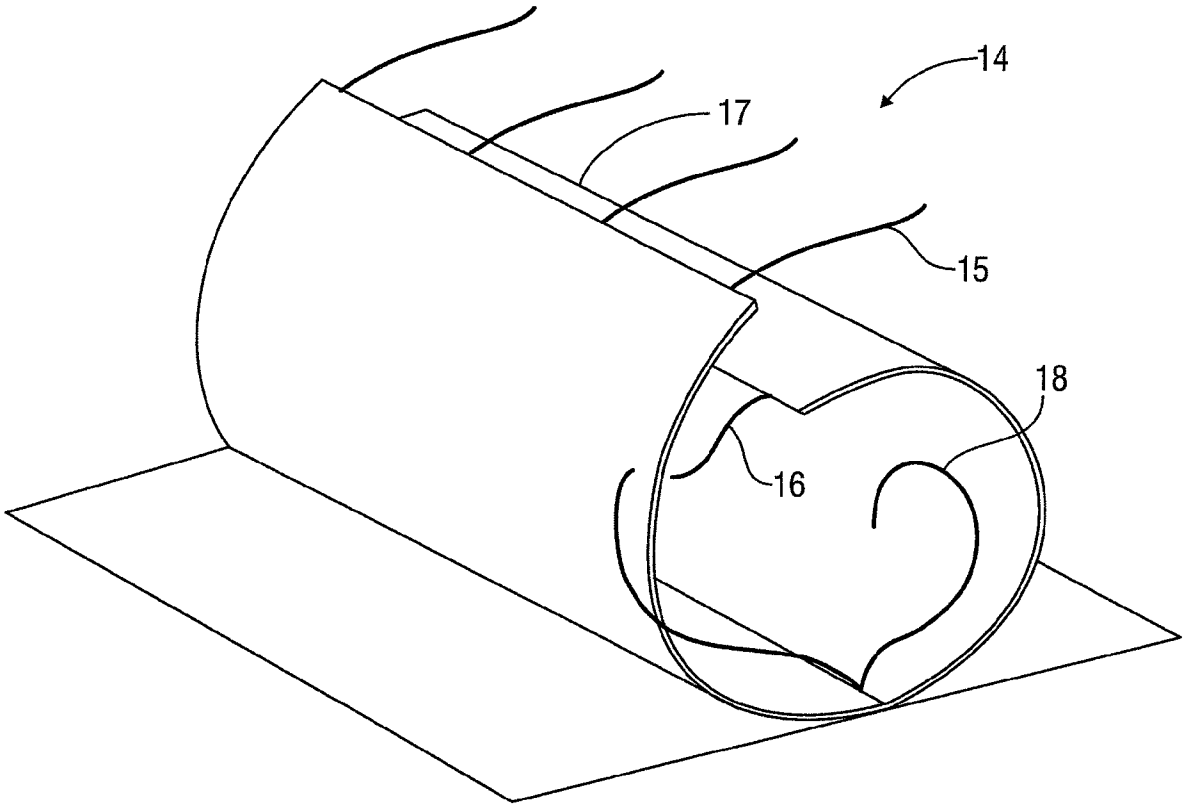
FIG. 3 illustrates schematically an angled side view of a fiber roll sleeve with an open top, according to another embodiment of the present invention. The sleeve comprises complementary strings along each of the loose ends of the sleeve.

In yet another embodiment, the body portion includes one or more pairs of strings placed along opposite sections of the body portion. The strings may be tied to connect opposite sections. Referring to FIG. 3, fiber roll sleeve 14 includes a pair of strings 15 and 16, one of each of the loose sections of the body portion 17. In this example, additional pairs of strings extend along the length of the loose sections, and the strings from opposite sections are tied to connect the sections together. A set of tie-down strings 18 may be sewn onto the hem of the fabric at one end of the sleeve. Additional sets of tie-down strings may be sewn onto the hem of the fabric; for example, a second set of tie-down strings (not shown) may be sewn at the opposite end of the sleeve. The tie-down strings may be wrapped around a fiber roll to secure the roll in place.

Figure 4A:
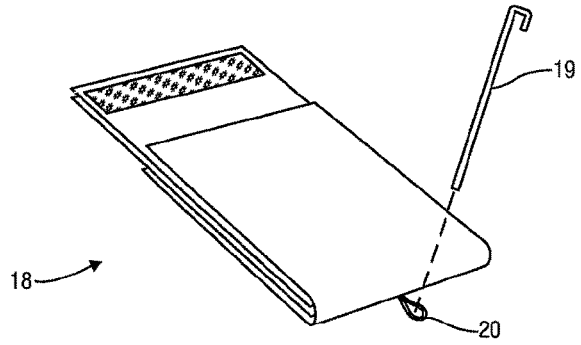
FIGS. 4A through 4C illustrate schematically the installation of a fiber roll sleeve with an open top around a fiber roll, according to one embodiment of the present invention. The sleeve includes an apron portion along one side.
Figure 4B:
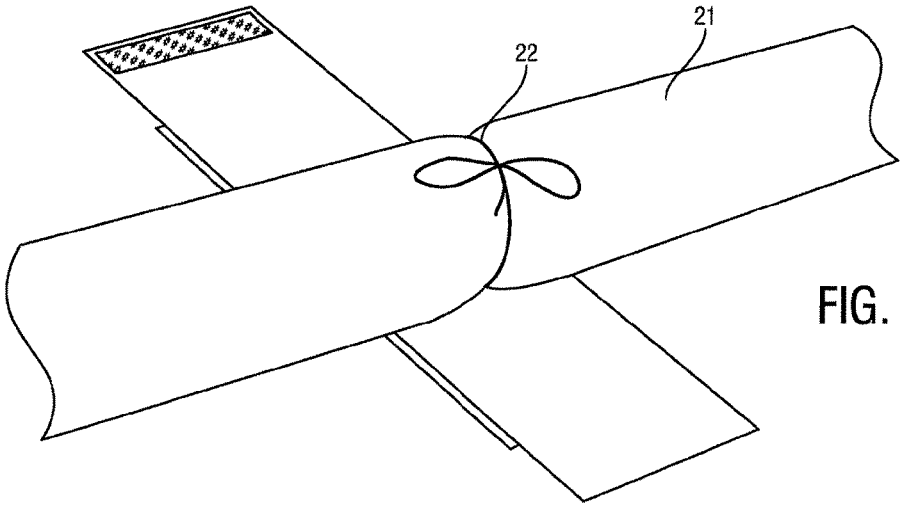
Figure 4C:
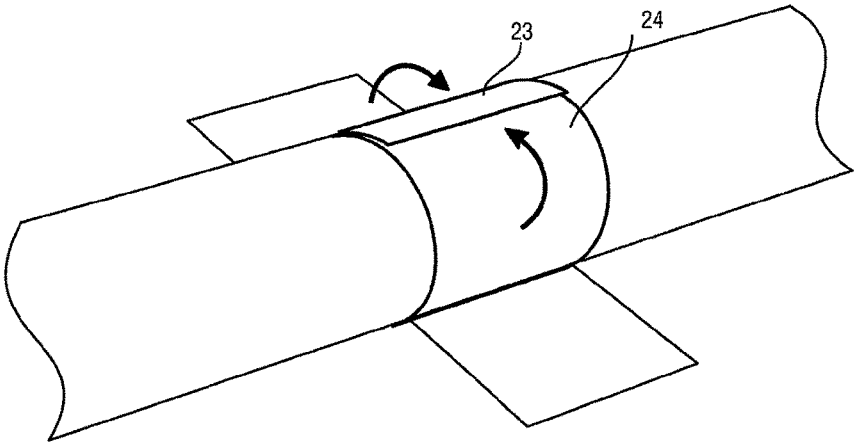

During construction, the open top sleeve with one or more apron portions may be fitted around one or more fiber rolls. As illustrated in FIG. 4A, exemplary fiber roll sleeve 18 with apron portions is laid on a ground surface. A bottom portion of the sleeve may be pinned to the ground using one or more installation pins 19 secured through one or more string hoops 20. As shown in FIG. 4B, the body portion of the sleeve is unfolded into an open position, with one surface of the body portion facing upward (away from the ground). A fiber roll 21 is placed over the sleeve, and the tie-down strings 22 are tied around the fiber roll to secure it in place. As shown in FIG. 4C, the two loose sections of the body portion 23 and 24 are wrapped around the fiber roll (over the tied strings) to close the sleeve. The segments are secured using one or more fastening mechanisms; for example, hook-and-loop closures that are located along the loose segments. In this preferred embodiment, with the string secured around the fiber roll and the assembly pinned to the ground, the fiber roll may be secured in place without the use of exposed wood stakes.

Figure 5A:
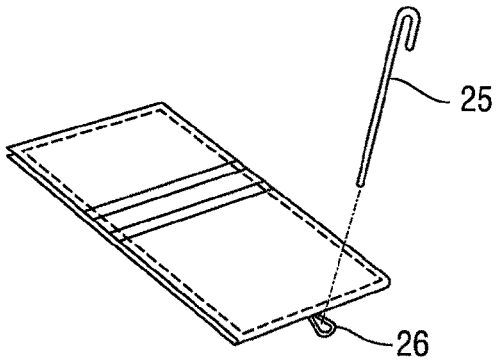
FIG. 5A through 5C illustrates schematically an exemplary installation of the fiber roll sleeve, according to one embodiment of the present invention.
Figure 5B:
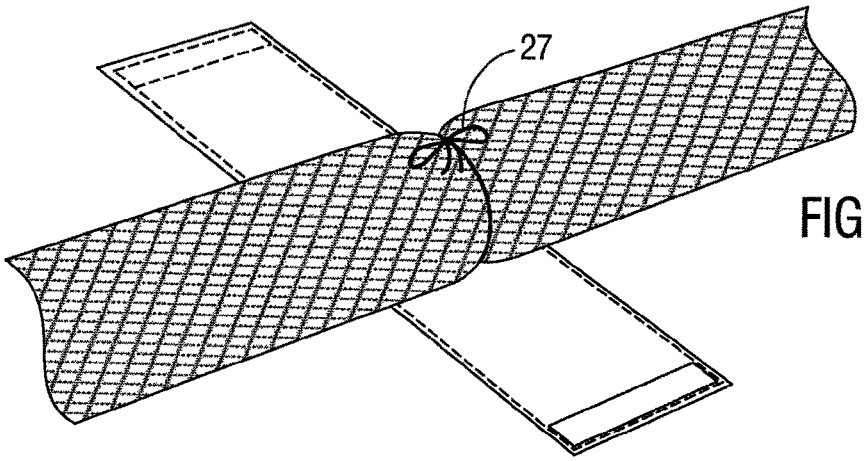
Figure 5C:
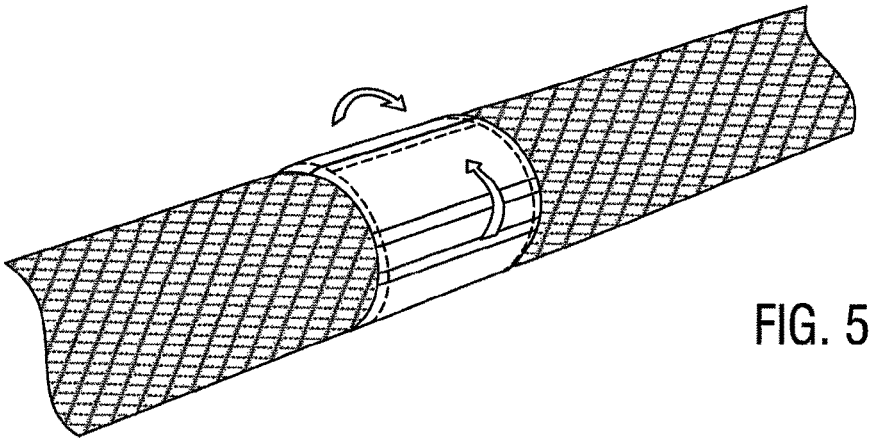

In another embodiment, the open top sleeve without an apron portion may be fitted around one or more fiber rolls. Referring to FIG. 5A, when installed along a surface, the sleeve may be folded and laid flat on the surface. Installation pin 25 is inserted through a hoop 26 located along an outside surface of the sleeve and into the ground. Referring to FIG. 5B, the sleeve is unfolded, and a fiber roll is placed over the sleeve. Tie-down strings 27, located along an inner surface of the sleeve, are secured around the fiber roll. Referring to FIG. 5C, the loose sections of the body portion are wrapped around the fiber roll and secured together using complementary hook-and-loop closures on the opposite sections of the sleeve.

Figure 6:
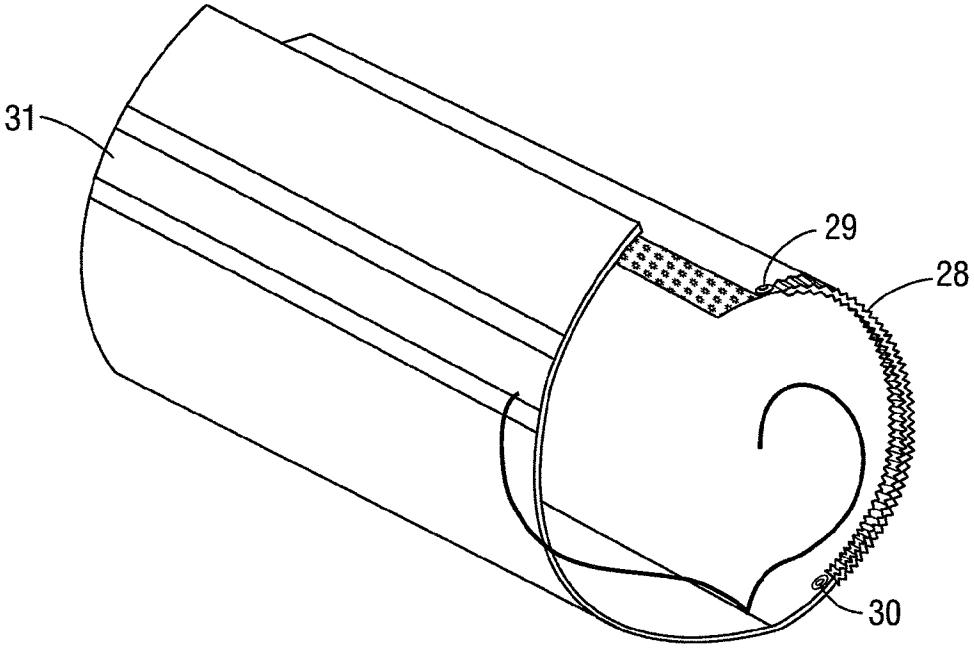
FIG. 6 illustrates schematically an angled side view of a fiber roll sleeve with an open top that includes a tensioning device, according to one embodiment of the present invention. The fiber roll sleeve also includes a reflective strip, which allows for increased visibility.

In yet other embodiments, the fiber roll sleeve of the present invention may also include one or more flexible tensioning devices to help secure the sleeve around one or more fiber rolls. The fiber roll sleeve may include a strap, one or more pieces of material, or other tensioning device placed along a side of the sleeve. As an example, in FIG. 6, the tensioning device may be formed from one or more elastic straps 28 sewn along at least part of the inside of the hem on one side of the sleeve. The elastic strap or other tensioning device provides tension and helps the sleeve to remain fitted around a fiber roll, particularly when the fiber roll changes dimension and/or shape.

Figure 7:
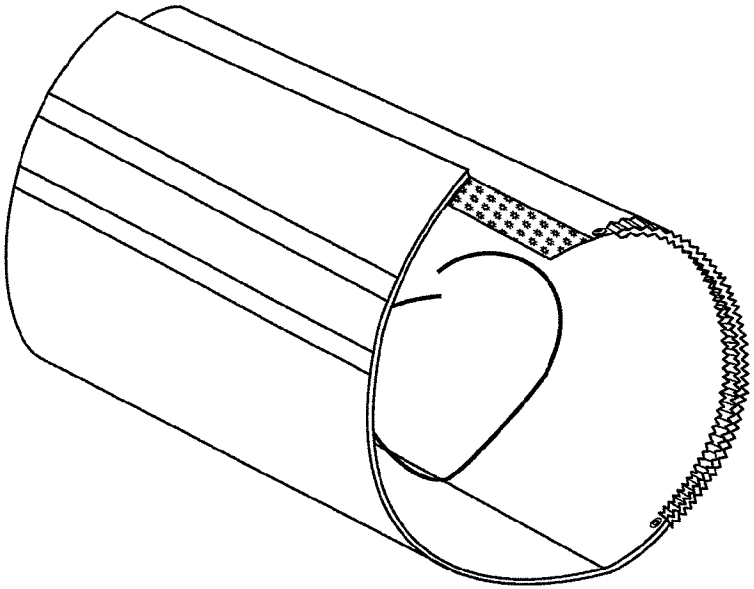
FIG. 7 illustrates schematically an angled side view of a fiber roll sleeve that includes a tensioning device, according to one embodiment of the present invention.
Figure 8:
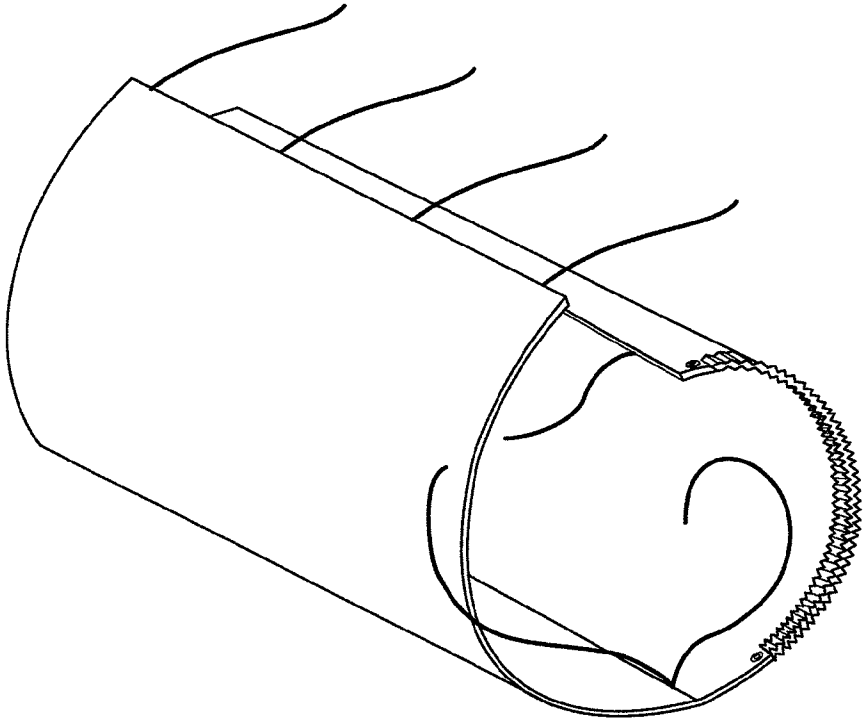
FIG. 8 illustrates schematically an angled side view of a fiber roll sleeve that includes a tensioning device, according to one embodiment of the present invention.
Figure 9:
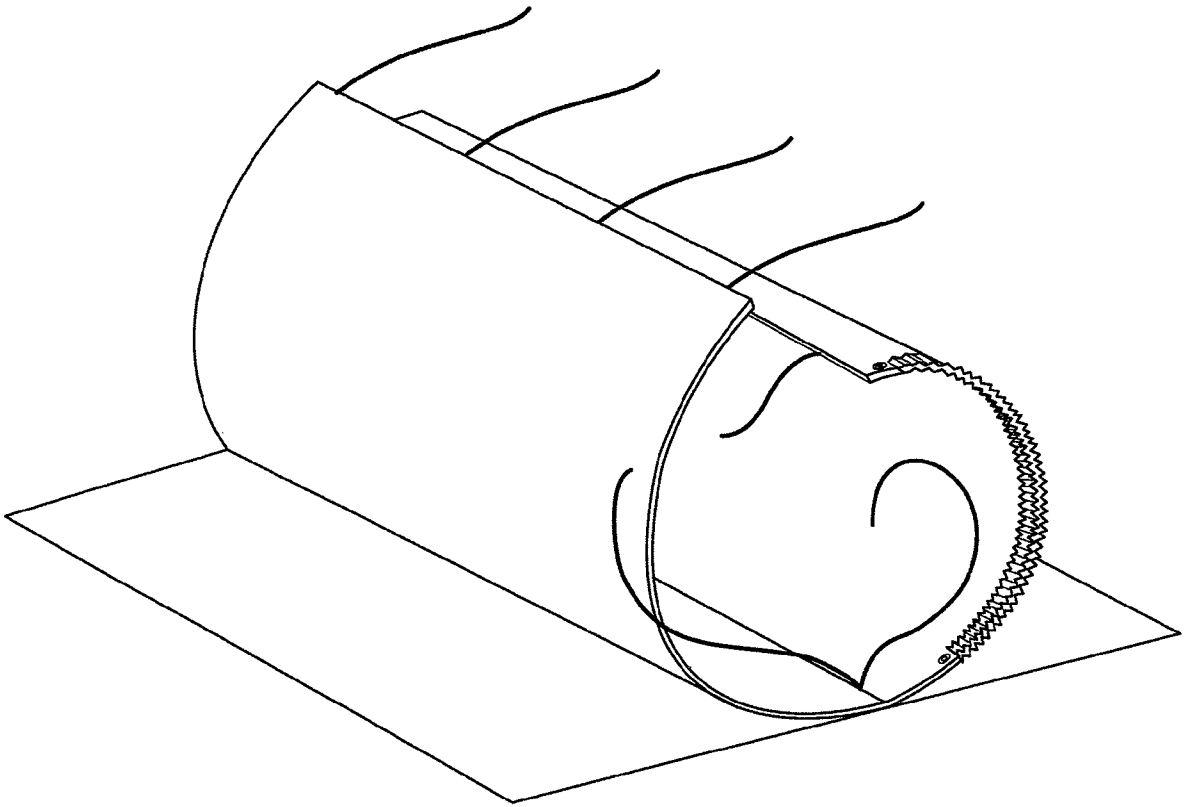
FIG. 9 illustrates schematically an angled side view of a fiber roll sleeve that includes a tensioning device, according to one embodiment of the present invention. The fiber roll sleeve includes an apron portion at one edge of the sleeve.

The tensioning device may be incorporated into the sleeve and secured using, for example, one or more snaps 29 and 30 that secures the strap to the sleeve. Additional elastic straps may be included, for example, along another side of the sleeve, to further aid in self-tensioning. A reflective strip 31 may be incorporated along a side of the sleeve to enhance visibility, particularly in dark settings. One or more hoops (not shown) may be attached to an outer side of the sleeve to help secure the sleeve to the ground or other surface. It will be appreciated that the tensioning device of the present invention may be a self-tensioning feature that is incorporated into a wide range of fiber roll sleeves, as shown in FIGS. 7 through 9.

It will also be appreciated that the fiber roll sleeve may be placed anywhere along the length of a fiber roll and in different combinations in a fiber roll assembly. For example, a fiber roll sleeve may be used as a cuff and placed around a segment of a single fiber roll. Multiple sleeves may be used with a fiber roll assembly of multiple fiber rolls and spaced as needed to secure the fiber roll sleeve in place and/or enhance visibility. A fiber roll sleeve may also be used at the joints of adjacent fiber rolls to couple the fiber rolls. For example, an end of the sleeve may be placed around an end of one fiber roll, while the other end of the sleeve is placed around an end of another fiber roll.

Figure 10A:
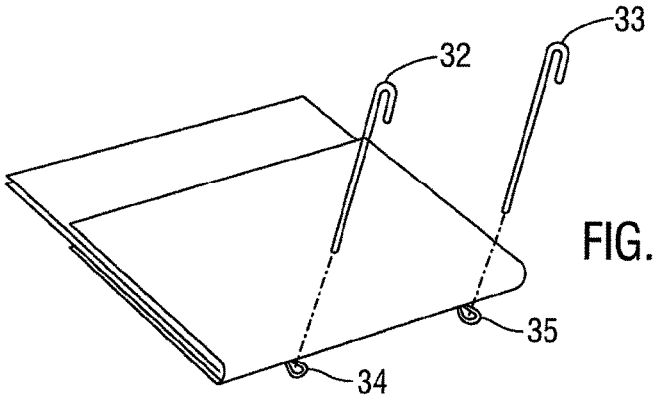
FIGS. 10A through 10C illustrate schematically in angled side view, an exemplary installation of a fiber roll sleeve around two fiber rolls, according to one embodiment of the present invention.
Figure 10B:
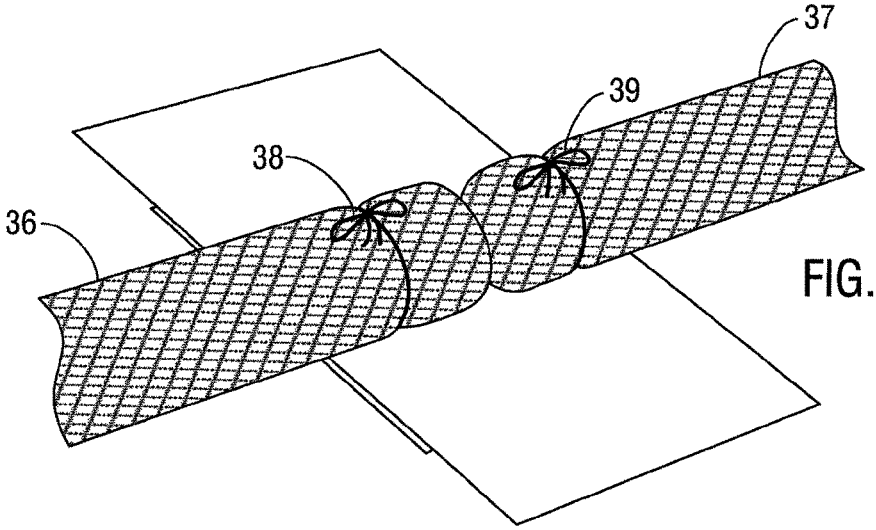
Figure 10C:
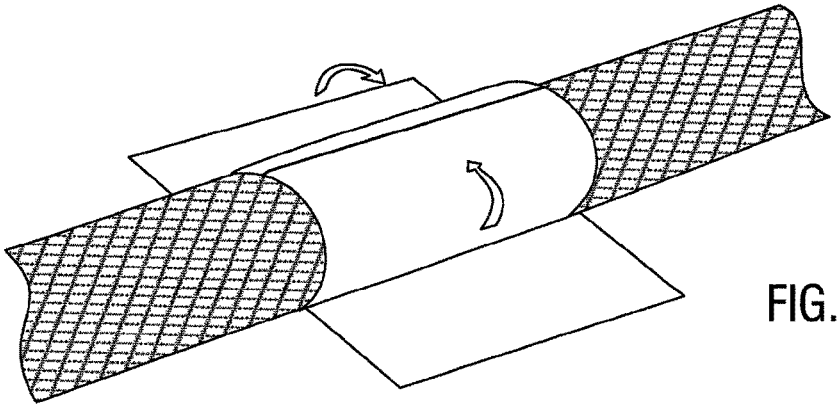
Figure 11A:
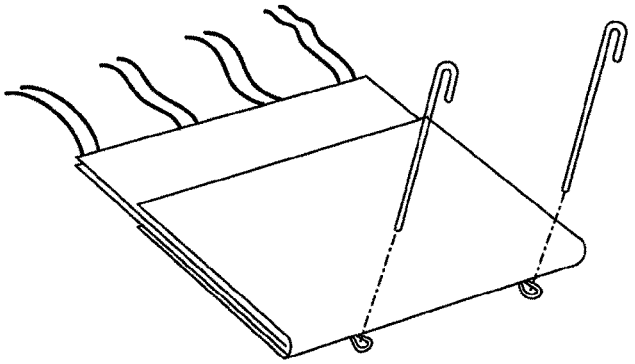
FIGS. 11A through 11C illustrate schematically in angled side view, an exemplary installation of a fiber roll sleeve around two fiber rolls, according to one embodiment of the present invention.
Figure 11B:
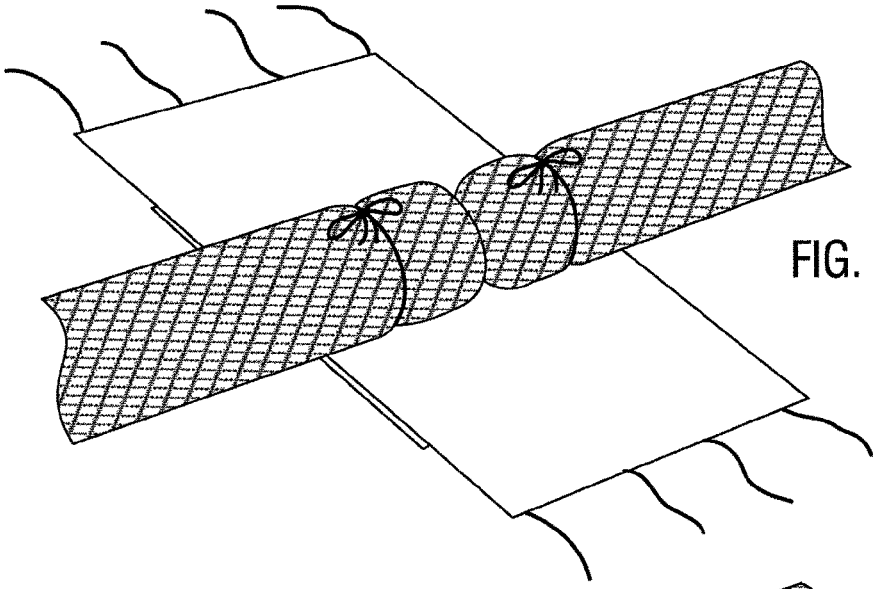
Figure 11C:
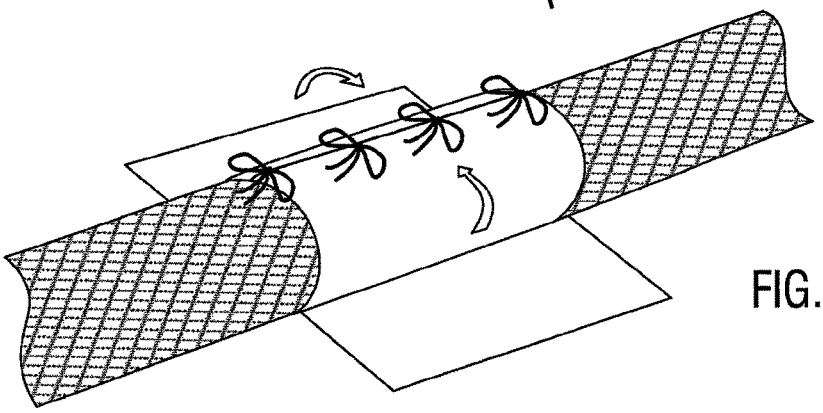
Figure 12A:
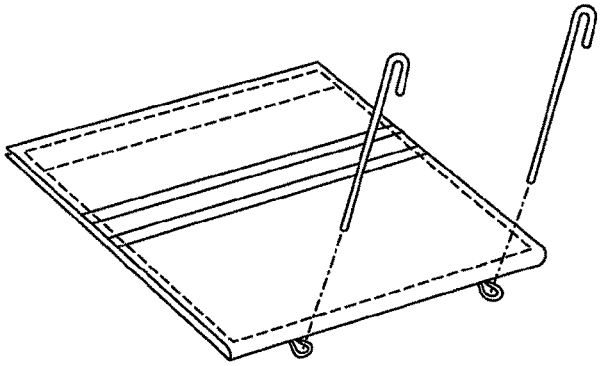
FIGS. 12A through 12C illustrate schematically in angled side view, an exemplary installation of a fiber roll sleeve around two fiber rolls, according to another embodiment of the present invention.
Figure 12B:
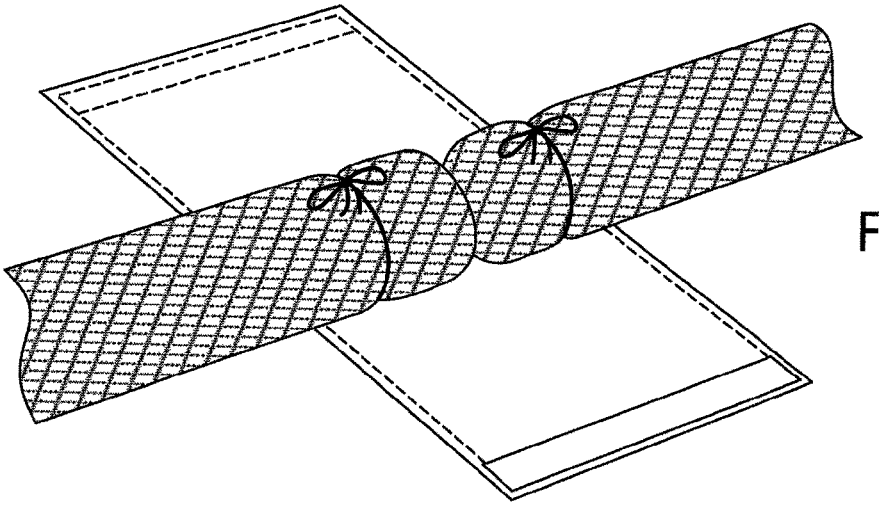
Figure 12C:
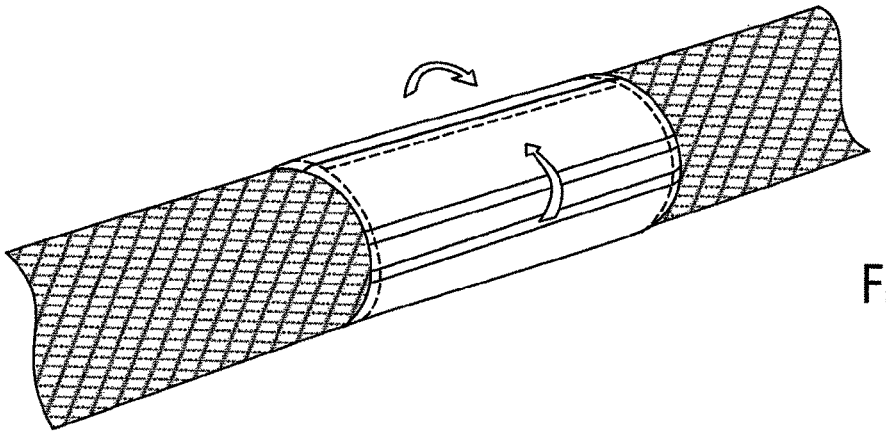

Referring to FIG. 10A, when installed along a surface, the sleeve may be folded and laid flat on the surface. Installation pins 32 and 33 are inserted through hoops 34 and 35, respectively, located along an outside surface of the sleeve and into the ground. As illustrated in FIG. 10B, the sleeve may be unfolded, and ends of abutting fiber rolls 36 and 37 are placed inside the unfolded sleeve. Tie-down strings 38 and 39, located along an inner surface of the sleeve, are secured around each fiber roll. As illustrated in FIG. 10C, the loose sections of the body portion are wrapped around the fiber rolls and secured using complementary hook-and-loop closures (not shown) or other connection devices that are located on the opposite sections of the sleeve. In another embodiment, as shown in FIGS. 11A through 11C, the fiber roll sleeve of the present invention may be secured at the joints of adjacent fiber rolls using complementary strings or closures located at opposite sections of the sleeve. The strings may be tied to connect the sections of the sleeve together. In yet other embodiments, the fiber roll sleeve of the present invention may be used without apron portions to couple adjacent fiber rolls, as illustrated in FIGS. 12A through 12C. The fiber roll sleeves may include reflective strips for labeling or instruction purposes, or to enhance visibility.

The examples of materials and components used to connect the open top of the body portion of the sleeve are provided for illustration purposes. The loose sections of the body portion may be connected using one or more closure devices, or a combination of different closure devices, known in the art for providing secure connections for fiber roll materials; including, without limitation, Velcro, hook-and-loop fasteners, thread, buttons, zippers, drawstrings, cords, twine, string, fasteners, snaps, staples, hooks, glue, pins, or other closure devices or other structures useful in the sealing, closure, formation, and maintenance of fiber roll components. Moreover, the closure devices may be placed anywhere along the loose sections of the body member to connect the body member around a fiber roll. In a preferred embodiment, the body portion of the sleeve is removably connected to the fiber roll to facilitate efficient removal and re-use of the sleeve.

In addition, the fiber roll also may be secured using the sleeve assembly through one or more other fastening devices and combinations of fastening devices known in the art for providing secure connections for fiber roll materials; including without limitation, Velcro, hook-and-loop fasteners, tie-down strings, strings, thread, buttons, zippers, drawstrings, cords, twine, string, fasteners, snaps, staples, hooks, glue, pins, or other structures useful in the closure, formation, and maintenance of fiber roll components. The fastening devices may be placed anywhere along the sleeve to secure the fiber roll. In certain embodiments, such as for those applications where a simple sleeve or cuff is needed for visibility or safety purposes, the fiber roll sleeve may be fitted around a fiber roll without an inner tie-down string or other fastening device.

The number of fastening devices used to secure the fiber roll may vary with the size of the sleeve. For example, for shorter sleeves covering a relatively small segment of a fiber roll, a single pair of fastening devices (e.g., tie-down strings or drawstrings) may be used to help keep the fiber roll in place. While for longer sleeves covering larger segments of a fiber roll or multiple fiber rolls, multiple pairs of fastening devices may be used.

The fiber roll sleeve of the present invention may also be secured in place using a variety of different posts, stakes, pins, including those installation pins and anchoring assemblies described below, used with or without a hoop at the base of the hem. In a preferred embodiment, exposed wooden stakes (with a top portion of the stake exposed above the fiber roll sleeve) are not needed to secure the fiber roll sleeve to the ground, thus eliminating potential safety hazards and simplifying maintenance of fiber rolls that use the sleeve.

B. Sleeves with Closed Top

In another embodiment, the fiber roll sleeve of the present invention may have a closed top. A flexible piece of material, for instance burlap fabric, is folded along a length of the fabric and sewn to form a tubular shape that fits around a cylindrical fiber roll. The sleeve can be fitted around at least a portion of one or more burlap-wrapped fiber rolls.

Figure 13A:
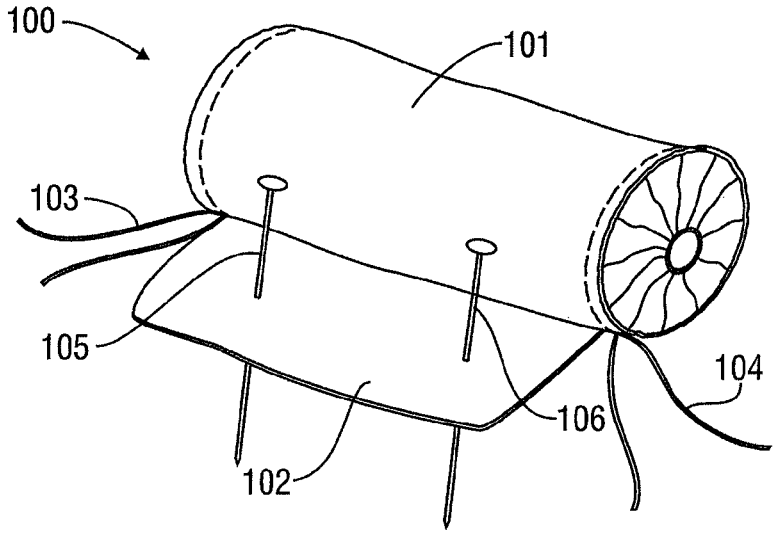
FIG. 13A illustrates schematically an angled side view of a closed-top fiber roll sleeve, according to another embodiment of the present invention.

Referring to FIG. 13A, sleeve 100 includes a unitary body portion 101 that can be formed into a tubular casing and fitted around a segment of a tube-shaped fiber roll. The sleeve includes a hollow interior and open portions at the ends. The sleeve also may include an apron portion 102 in the shape of a wide hem that extends past an edge of the body portion.

In this embodiment, the sleeve is formed from a substantially rectangular piece of fabric that is folded lengthwise. The fabric is sewn along a line that is substantially parallel to the fold so that the fabric can form a tubular shape that can be fitted around a tube-shaped fiber roll. It may be sewn to complement the shape of a tubular fiber roll. Although shown here as substantially rectangular in shape, it is contemplated that the sleeve and the material used to form the sleeve may take one of any known shapes capable of fitting around all of at least a portion of different types of fiber rolls (e.g., substantially circular, substantially round, substantially triangular, or irregularly shaped). Drawstrings 103 and 104 or other suitable closure devices are incorporated at opposite ends of the sleeve. Installation pins 105 and 106 may be added to help secure the sleeve to the ground or other surface.

Figure 13B:
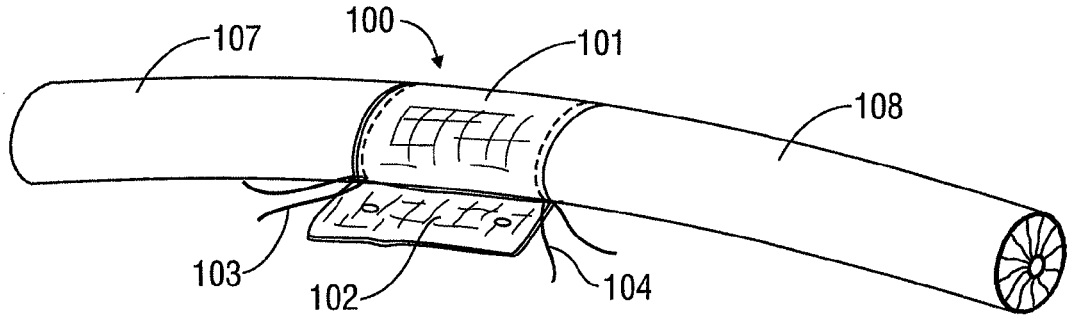
FIG. 13B illustrates schematically a perspective view of the fiber roll sleeve of FIG. 13A positioned between two fiber rolls.

The sleeve may be placed over one or more fiber rolls to minimize the gap between adjacent ends of the rolls. As illustrated in FIG. 13B, part of the body portion 101 is fitted around an end segment of a fiber roll 107. Another part of the body portion 101 of the sleeve is fitted over an end segment of an adjacent fiber roll 108. Drawstrings 103 and 104, or other closure devices, are cinched at the ends to secure the sleeve to the respective end segments of each fiber roll 107 and 108, respectively.

In an exemplary embodiment, the body portion is designed to fit around standard sized fiber rolls. The body portion of the sleeve measures approximately 18 to 24 inches in length and 8 to 9 includes in diameter. The shapes and dimensions described are provided for illustrative purposes, however, and they are not intended to limit the scope of the invention. The ordinary artisan will recognize that the shape of the sleeve and its dimensions can be varied based on a range of design options available; e.g., materials, erosion control application, site specifications, and the sizes and types of fiber rolls used with the sleeve.

Figure 14A:
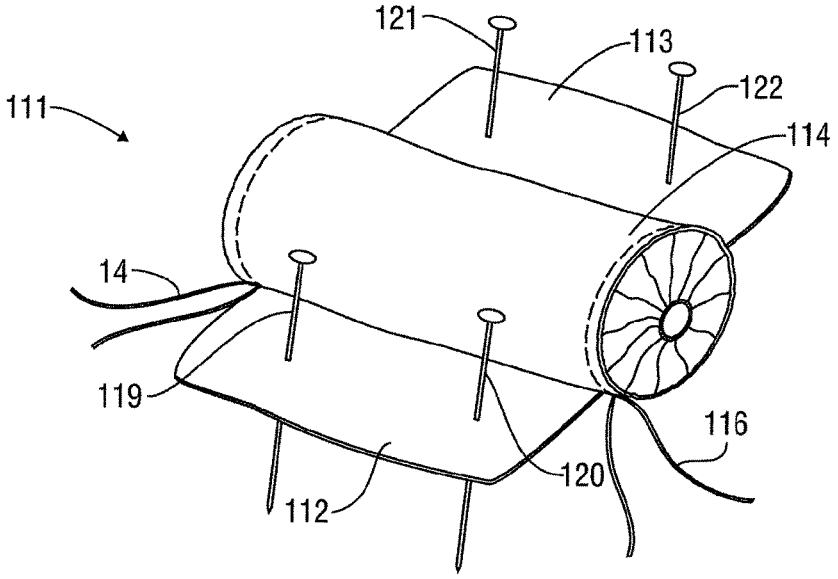
FIG. 14A illustrates schematically an angled side view of a fiber roll sleeve according to another embodiment of the present invention. The sleeve includes two apron portions along sides of the sleeve.
Figure 14B:
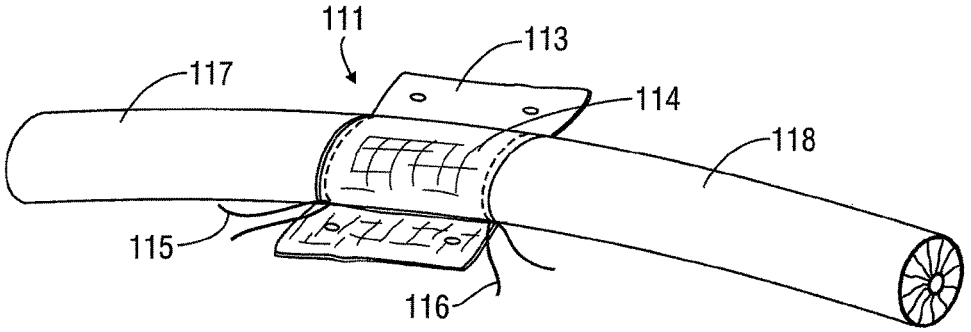
FIG. 14B illustrates schematically a perspective view of the fiber roll sleeve of FIG. 14A positioned between two fiber rolls.

Referring to FIG. 14A, in another embodiment, a sleeve 111 may include two apron portions 112 and 113. Each apron portion may take the form of a wide hem located on different sides of the sleeve. Both apron portions extend past edges of the body portion 114 of the sleeve. As illustrated in FIG. 14B, when used to connect side-by-side fiber rolls, drawstrings 115 and 116 are cinched to secure an open portion of the sleeve to an end segment of a fiber roll 117. Another open portion of the sleeve is fitted over an adjacent end segment of another fiber roll 118. One or more anchoring structures, such as metal or plastic pins 119, 120, 121, and 122, are placed through the apron portions and driven into the surface on opposite sides of the fiber roll to help secure the apron member to the ground (not shown). In some embodiments, the apron portions can be secured to one or more sloped surfaces at regions above and below the fiber roll.

Figure 15:
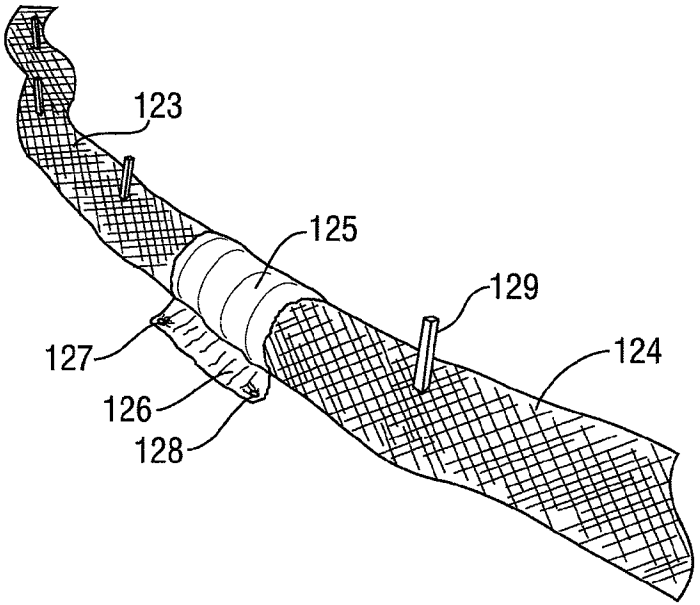
FIG. 15 illustrates schematically an installation of an exemplary fiber roll sleeve according to one embodiment of the present invention.

During construction, a fiber roll sleeve may be used with adjacent fiber rolls to curtail erosion along a sloped surface. FIG. 15 illustrates schematically an installation of two fiber rolls 123 and 124. The fiber rolls are laid along their length in a shallow trench. Sleeve 125 is rolled over an end segment of one of the fiber rolls. A second fiber roll is laid next to the first roll, preferably tightly to minimize the space separating the fiber rolls. The sleeve is rolled over the end segment of the adjacent fiber roll. The apron portion 126 of the sleeve is pinned to the ground using installation pins 127 and 128. Wooden stakes 129 are driven through the fiber rolls for added stability. Additional fiber rolls may be similarly attached to the ends of the fiber rolls until an erosion control roll and/or sediment barrier of a desired coverage length is reached.

It is contemplated that one or more ends of the fiber rolls described in the present invention may be optionally sealed or partially sealed to minimize the loss of material (e.g., straw or other fiber) at the ends. Devices that may be used to seal the ends of fiber rolls include, without limitation, drawstrings, snaps, buttons, zippers, cords, twine, Velcro, straps, clips, fasteners, pins, staples, plugs, hooks, or other structures useful in the sealing, closure, formation, maintenance, and repair of fiber rolls.

In described in certain examples above, the sleeve may be used to couple adjacent fiber rolls. In so doing, the sleeve may create a bridge between the ends of connected fiber rolls, functioning much like a silt fence. For example, the sleeve may help to direct flows and/or filter stormwater that would otherwise flow between the ends of the fiber rolls.

The sleeve of the present invention may also be used to secure a fiber roll to the ground, both at the joints or along the fiber roll length. For example, instead of or in addition to being secured around ends of adjacent fiber rolls, the fiber roll sleeve of the present invention may be secured anywhere along the axial length of one or more fiber rolls.

Figure 16:
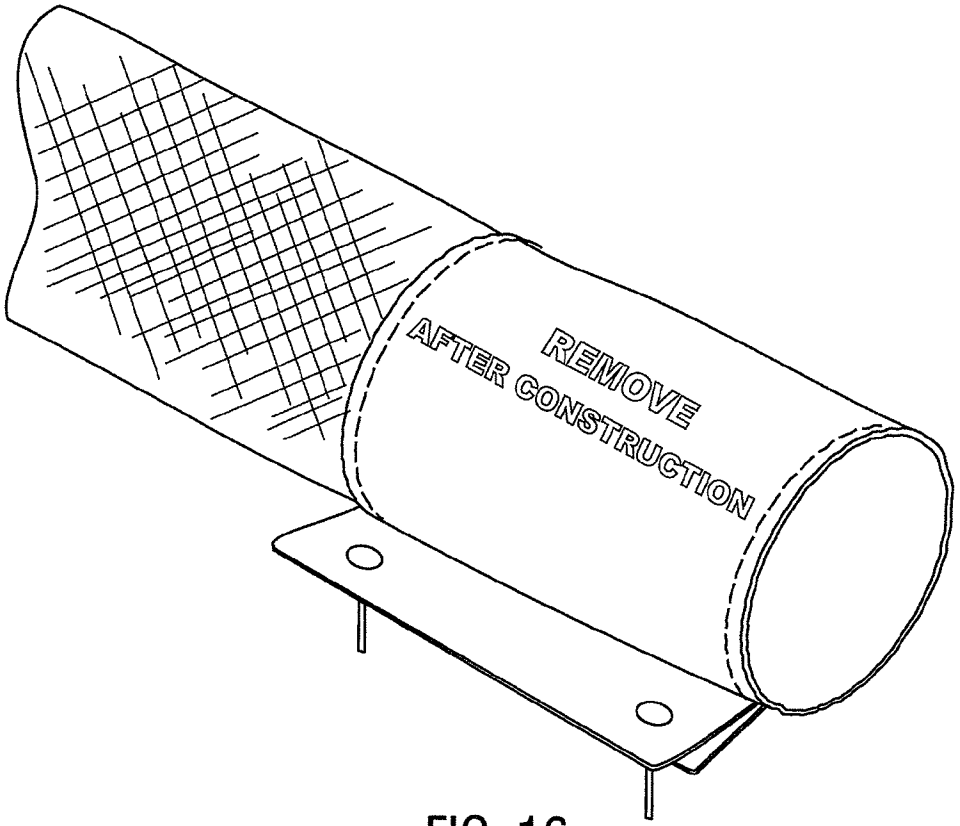
FIG. 16 illustrates schematically a perspective view of a fiber roll sleeve displaying instructions for use.

The sleeve may also be useful for identification, increased visibility and/or safety purposes. For example, the fiber roll sleeve may be bright orange in color and used in hazardous areas where high visibility is desired. Such an orange colored fiber roll member can function as a safety device that can be placed at the joints or anywhere along the length of the fiber rolls. The fiber roll sleeve also may incorporate text for labeling, identification, branding, and/or instructions for use, as shown in FIG. 16.

In addition, the fiber roll may be secured to the sleeve assembly through one or more other fastening devices in the art for providing secure connections for fiber roll materials; including without limitation, drawstrings, strings, thread, buttons, zippers, cords, twine, string, fasteners, snaps, staples, hooks, glue, pins, or other structures useful in the closure, formation, and maintenance of fiber roll components. The fastening devices may be placed anywhere along the sleeve to secure the fiber roll. In certain embodiments, such as for those applications where a simple sleeve or cuff is needed for identification or safety purposes, the fiber roll sleeve may be fitted around a fiber roll without an inner drawstring or fastening device.

In some embodiments, the sleeve of the present invention may be formed from a separate piece of material, separate from the fiber roll. In another preferred embodiment, the sleeve may be used as a retrofit to couple fiber rolls after they have been manufactured. This embodiment allows for the coupling of pre-fabricated fiber rolls along a landscaped area or construction site. In a preferred embodiment, the sleeve may be removed from the fiber roll.

The closed top fiber roll sleeve may also be secured in place using a variety of different posts, stakes, pins, including those installation pins and anchoring assemblies described below, used with or without a hoop at the base of the hem. In a preferred embodiment, exposed wooden stakes (with a top portion of the stake exposed above the fiber roll sleeve) are not needed to secure the fiber roll sleeve to the ground, thus eliminating potential safety hazards and simplifying maintenance of fiber rolls that use the sleeve.

C. Integrated Sleeves

Figure 17:
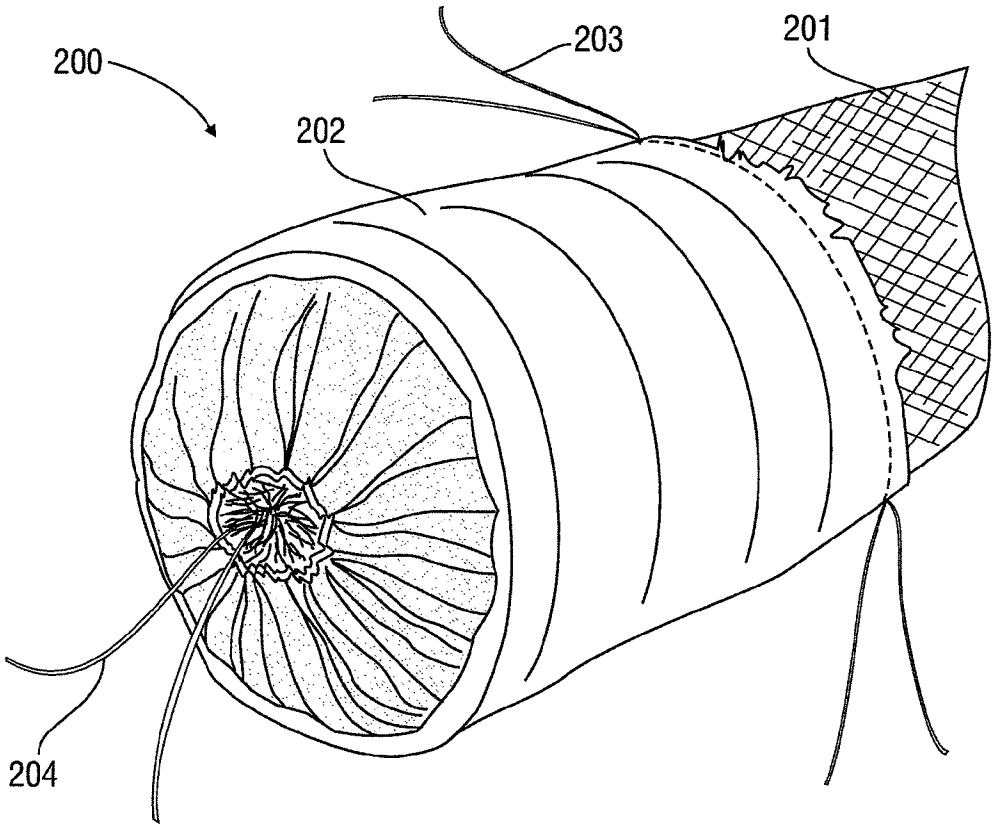
FIG. 17 illustrates schematically an angled top view of a fiber roll with an integrated sleeve in accordance with another embodiment of the present invention. The integrated sleeve is folded back onto the fiber roll, and a cinched drawstring provides a closure for an end of another fiber roll.

FIG. 17 illustrates an angled top view of a fiber roll member according to another embodiment of the present invention. In this embodiment, sleeve 200 is integrated with fiber roll 201. The integrated sleeve can be integrated with the fiber roll in one of many ways known in the art of forming fiber rolls. As a non-limiting example, the sleeve may be sewn onto an end segment of the fiber roll during fabrication.

One end of the sleeve (not shown) is attached to an outside surface of the fiber roll 201, while the other end includes an extension portion 202 that can be pulled past an end of the fiber roll. The extension portion has a drawstring 203 or other closure device around an end area. As shown in FIG. 17, the extension portion may be folded or rolled back around an end area of the fiber roll, to facilitate transport, handling, and storage of the fiber roll when it is not in use. The fabric covering a terminal region of the fiber roll is closed, for example with a cinched drawstring 204 or other closure device, to form a closure wall and prevent loss of material from the fiber roll at the terminal region.

Figure 18:
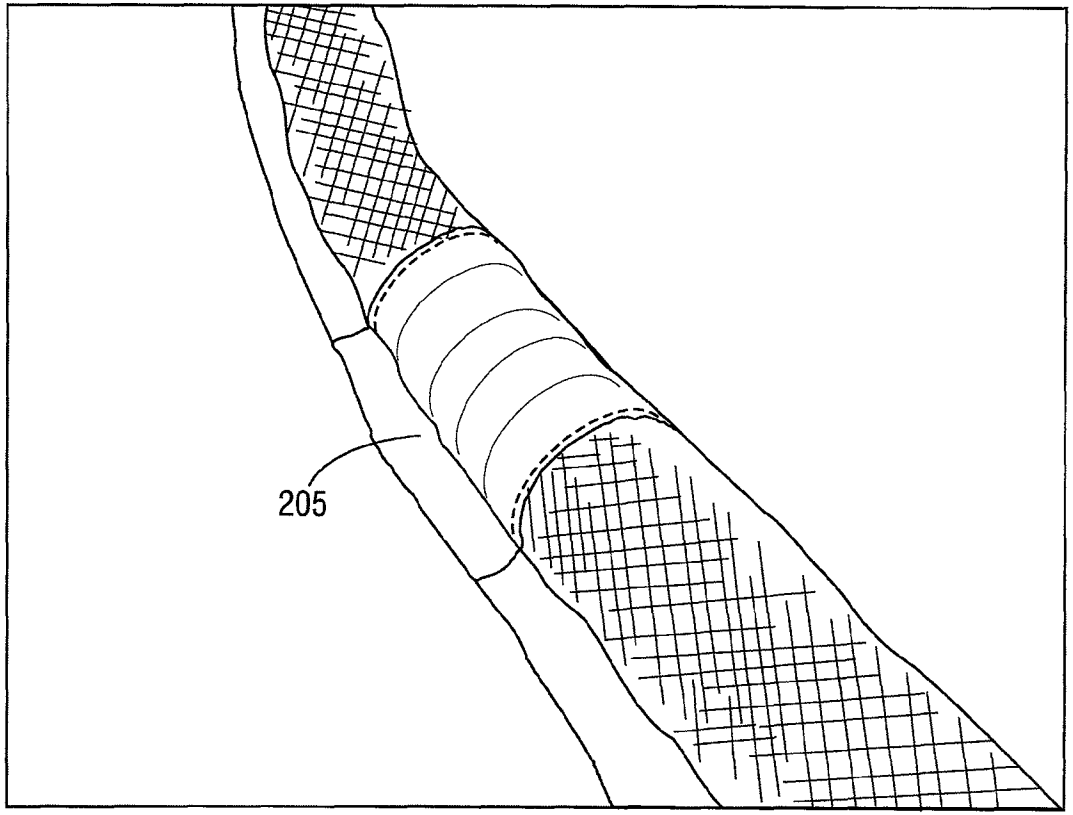
FIG. 18 illustrates schematically a side view of a fiber roll with an integrated sleeve abutting another fiber roll in accordance with one embodiment of the present invention.

During installation, the fiber roll with the integrated sleeve is laid next to another fiber roll. Adjacent fiber rolls may be in contact with each other. Alternatively, a space, one or more materials, or other intervening structures may separate adjacent fiber rolls. In a preferred embodiment, the ends of the adjacent fiber rolls are placed tightly next to each other to minimize the leakage of water and/or dissipate the flow of fluid in the area between the fiber rolls. The extension portion of the sleeve is unfolded or unrolled, and fitted over an end segment of the adjacent fiber roll. The drawstring around the end area of the extension portion can be cinched around the adjacent fiber roll, as shown in FIG. 18. The sleeve has an apron portion 205 that complements the apron portion of the two fiber rolls on either end of the sleeve, to form a continuous apron along the length of the structure.

It is contemplated that one or more end portions of fiber rolls described above may be optionally sealed or partially sealed to minimize the loss of material (e.g., fiber) at the terminal ends. Devices used to seal the ends of fiber rolls include, without limitation, drawstrings, cords, twine, snaps, buttons, zippers, thread, Velcro, straps, clips, fasteners, pins, staples, plugs, or other structures useful in the sealing, closure, formation, and maintenance of fiber rolls.

In addition, the sleeves described above may be integrated with one or more fiber rolls using methods (or a combination of methods) known in the art to secure materials to fiber rolls; including without limitation, rolling or fitting the sleeve over a surface of the fiber roll, and/or attaching the sleeve to the fiber rolls via thread, cords, twine, string, drawstrings, fasteners, snaps, staples, hooks, glue, pins, or other fastening devices.

D. Dimensions, Materials, and Configurations

It is contemplated that the dimensions of the fiber roll members, including fiber roll sleeves and cuffs, of the present invention can vary within a range dependent on one or more design factors including but not limited to: overall system and site configuration, dimensions of the fiber rolls, dimensions of the site or sloped surface, desired water flow capacity, desired weight, desired amount of water flow to be managed, and the size and structure of the overall erosion control system in which the fiber roll member is used.

It is further contemplated that the materials useful for fiber roll members of the present invention can vary within a range dependent on one or more design factors including but not limited to: desired weight, ability to be secured to a fiber roll, desired permeability or impermeability, durability, structural stability, strength, and climate resistance. In various embodiments of the present invention, materials useful for construction of the fiber roll members include but are not limited to: UV degradable polypropylene, other UV degradable material, polypropylene netting, propylene material, woven geotextile fabric, open netting, felt, burlap, hemp, cotton, fabric, biodegradable material, or any other materials that can be formed around and effectively secured to erosion control and/or sediment control devices.

The materials used for construction may be selected for particular applications and to complement the materials used in fiber rolls. The fiber roll member of the present invention may be constructed of the same material used in the fabrication of the fiber rolls with which the member is used. For example, the integrated sleeve may be formed from the same material used to construct the wattle (e.g., burlap). The sleeve and the fiber roll form a unitary structure. The fiber roll member also may be formed from a separate burlap sleeve and used as a joint connector for burlap-encased or other biodegradable wattles.

Alternatively, the fiber roll member may be constructed of different material, or a combination of same and different materials. For example, a fiber roll sleeve may be formed from a black fabric sleeve and used as a joint connector for wattles with plastic netting. The sleeve could be constructed of burlap and used with plastic netted fiber rolls. Alternatively, the fiber roll member may include a wide orange fabric (e.g., 18-inch wide fabric) for use as a joint connector for burlap or netted wattles. In yet other embodiments, the fiber roll member may be formed from a narrower orange fabric (e.g., 8-inch wide fabric) and used along the length of a single burlap wattle or a single netted wattle to secure the wattle in place and enhance visibility.

It may be appreciated that a number of connection structures known in the art for securing fiber rolls may be used to help stabilize the fiber rolls, including the apron portions, to the ground. They include, without limitation, one or more stakes, nails, staples, bolts, screws, clips, hinges, fasteners, pins, installation pins, or one or more of the anchoring assemblies that will be described below. Moreover, in some embodiments, the apron members may be secured to the ground or other surface without using exposed wooden stakes. Thus, the use of fiber roll members of the present invention may also eliminate or reduce the need for securing the wattle in place with wooden stakes, which may pose a safety hazard when installed in areas subject to foot traffic, such as adjacent to a sidewalk or parking lot.

In some embodiments, the components of the present invention may be used as part of a temporary installation. For example, the fiber roll member may be made of a filter fabric, woven or non-woven, or other type of casing material. It can be used with UV degradable polypropylene fiber rolls during construction of a site and removed after construction is complete.

In other embodiments, the components of the present invention may be used as part of a permanent installation. For example, the fiber roll member may be made of a biodegradable fabric, such as burlap or hemp. The fiber roll member can be used with burlap wattles and left in place in a landscaped area.

In a preferred embodiment, the fiber roll member of the present invention may be signed and constructed to include an area for branding, text, or other signage. The body portion of the fiber roll member may display, for instance, instructions for use or a hazard warning. The body portion may include coloring or be designed for high visibility. For example, in one embodiment, the body portion may be bright orange in color and used in hazardous areas where high visibility is desired. Such an orange colored fiber roll member can function as a safety device that can be placed at the joints or anywhere along the axial length of the fiber rolls. Alternatively, the body portion can be colored to blend in with the surroundings; for example, using a black or other dark color material.

The fiber roll member may be placed anywhere along the length of a fiber roll and in in a fiber roll assembly. For example, a fiber roll sleeve may be used as a cuff and placed around a segment of a single fiber roll. A fiber roll sleeve may also be used at the joints of adjacent fiber rolls to couple the fiber rolls. For example, an end of the sleeve may be placed around an end of one fiber roll, while the other end of the sleeve is placed around an end of another fiber roll.

In another embodiment, a wattle or a fiber roll assembly may be made up of a plurality of fiber roll members. As a non-limiting example, for a wattle length of about 25 feet, fiber roll members can be placed at joints, spaced at about 4 foot intervals (center to center) along the entire length of the wattle. Alternatively, the fiber roll members may be spaced closer apart, further apart, or next to each other. Installing fiber roll members in this manner helps to add visibility to fiber rolls. In addition, combinations of different fiber roll members may be used in a landscaped area, depending on the needs of the area.

As discussed, the fiber roll members may include one or more optional apron portions made of the same (or different) fabric used to construct the body portion. In some embodiments, the aprons portions of the sleeve may be modified to form pouches. The pouches may be used to contain sand, gravel, or other ballast. The pouches could be sealed with Velcro or other sealing methods to allow for filling in the field. This embodiment would facilitate the use of the sleeve on improved (e.g., hard) surfaces. In yet other embodiments, the fiber roll member can be constructed without an apron portion.

The addition of reflective tape material to one or both sides of the fiber roll member may enhance the visibility of the fiber roll member during darkness. Such material may be sewn or otherwise attached to the fiber roll member; for example, along a length of the body member. Use of reflective tape material with the fiber roll member may also facilitate compliance with state or federal safety standards. The incorporation of one or more battery or solar-powered lights; for example, blinking lights along an outside surface of a fiber roll sleeve; may also facility visibility and night time use.

These are merely illustrative examples of various fiber roll members in some embodiments of the invention. While possible configurations, fiber roll couplings, sleeve couplings, and general sleeve and structural shapes are shown in the figures, it is within the scope and contemplation of the invention to introduce fiber roll members and systems in other configurations (for example, corner, end, or "T" configurations) using different couplings, fasteners, and shapes.

It is also within the scope of the invention to couple multiple units, such as multiple fiber rolls, using a single fiber roll member. In addition, as known by those of skill in the art, the dimensions of the fiber roll members, and the sizes of the openings, may vary to accommodate different design considerations, such as different widths, circumferences, lengths, and heights (outside and inside dimensions), desired weights for each fiber roll unit, and water flow volumes. The ordinary artisan also will recognize that the absolute dimension of the holes, slots, and openings can be selected to accept industry standard connections/fittings.

Moreover, the fiber roll members of the present invention are designed to wrap substantially fully or partially around one or more segments of a fiber roll. For example, the fiber roll member may be designed to fit around three sides of a rectangular-shaped fiber roll, while leaving the fourth side open. Alternatively, the fiber roll member may be designed to fit around a tubular fiber roll at a middle segment, away from the end segments.

Any of a multitude of complementary shapes that allow for fluid flow through fiber rolls and well known to the ordinary artisan could be used for the fiber roll members and fiber roll systems. Such shapes offer flexible and effective connections between fiber rolls and their components and for controlling water flow into and out of a landscaped area. They include, without limitation, substantially tubular, round, rectangular, block-shaped, square, triangular or circular fiber roll members.

In addition, the fiber roll members can be designed to fit with any of a multitude of complementary fiber roll shapes, including without limitation: substantially tubular, round, rectangular, block-shaped, square, triangular, or circular fiber rolls.

The structure of the fiber roll members described above greatly facilitates the fabrication and construction of fiber roll systems. Both simple (e.g., adjoining of the same fiber rolls) and more complex systems (e.g., use of multiple fiber roll units with outlet flow control, water filtration systems, and other features) of inter-connected fiber rolls can be built that provide sufficient strength and structural integrity for a wide range of erosion control applications.

The particular components, features, structures, or characteristics described herein may be combined in any suitable manner in one or more embodiments of the present invention. For example, the fiber roll members of the present invention may include different combinations of components, including without limitation different combinations of one or more of the following components: closures, fasteners, hoops, tie-down strings, apron portions, tensioning devices, connection devices, fastening mechanisms, installation pins.

II. Additional Anchoring Assemblies

The present invention also provides for anchoring assemblies for installing the exemplary fiber roll members described above, standard fiber rolls, or other fiber roll components in a construction site or other landscaped area.

In preferred embodiments, the fiber roll can be secured to the ground surface using the anchoring assemblies of the present invention without any need (or with only minimal need) to drive a conventional stake through the entire fiber roll. And because a stake does not protrude above the top of the fiber roll (or only minimal number of stakes do so), this assembly has the added benefit of reducing the potential safety hazards that accompany the use of conventional stakes in high traffic areas.

In one embodiment, the anchoring assembly may include one or more strings looped through one or more installation pins.

Figure 19C:
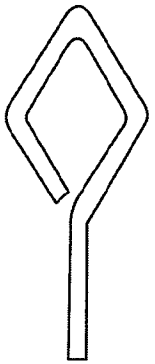
FIGS. 19A through 19C illustrate side views of installation pins in accordance with other embodiments of the present invention.

Metal installation pins of varying shapes may be used to secure a fiber roll (with or without a fiber roll sleeve) to a ground surface. Referring to FIG. 19A, one or more installation pins with hooked ends may be placed through one or more apron portions of an open top fiber roll sleeve, for instance (or another fiber roll member). The hooked end has a U-shape at the top portion of the pin, which is formed from the upper part of the base pin, a traverse section, followed by a longitudinal section. As a non-limiting example, the installation pin may be made of mild steel (11 GA to 8 GA) and measure approximately 8 inches in length. The transverse section of the hook measures approximately 0.75 inches, while the longitudinal section of the hook measures approximately 1 inch in length.

Figure 19B:
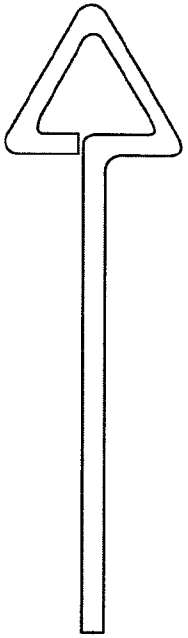
Figure 19A:
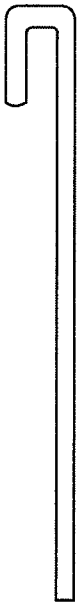

Referring to FIG. 19B, an installation pin with a triangular end may be placed through one or more apron portions of a fiber roll sleeve. For a metal pin measuring approximately 8 inches in length, the triangular end may measure 1 inch in length and 1 inch in height. In yet another embodiment, shown in FIG. 19C, an installation pin with a diamond shaped end may be used.

The installation pin may be used to secure a fiber roll, without the use of a fiber roll member such as a sleeve. In this embodiment, twine or string is attached to a top of the metal installation pin by running the twine or string through the hook or loop of the pin; e.g., through a U-shaped, triangular, diamond-shaped, or other shaped hook or loop. The pin is driven into the ground beneath a fiber roll. The string is tied around the fiber roll, securing the fiber roll in place. This method is advantageous because the installation pins are not exposed above the fiber roll.

Figure 20B:
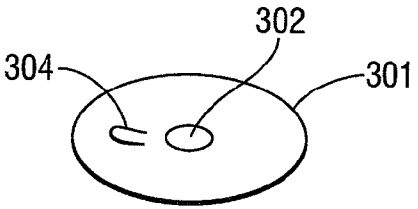
FIG. 20B illustrates an angled top perspective view of the circular disc-shaped structure of FIG. 20A.
Figure 20C:
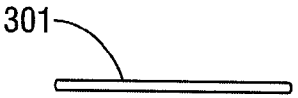
FIG. 20C illustrates a side perspective view of the circular disc-shaped structure of FIG. 20A.
Figure 20A:
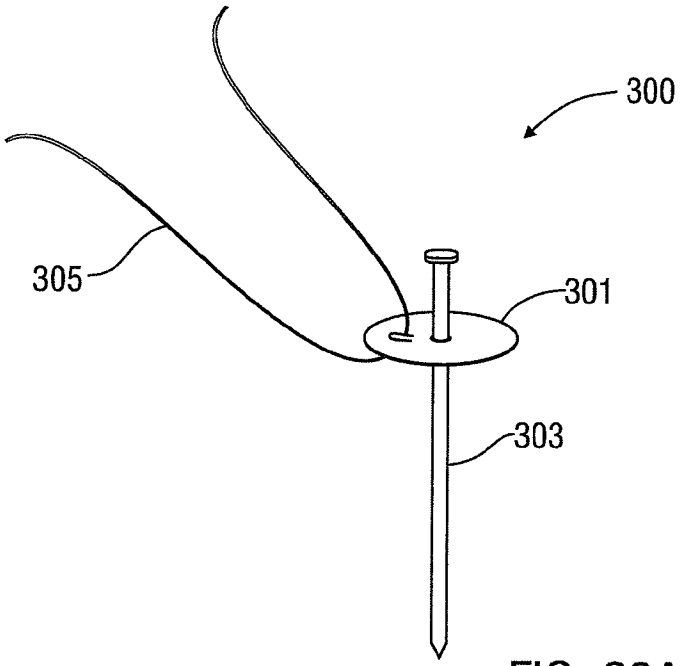
FIG. 20A illustrates a perspective view of a pin-disc assembly with a string in accordance with one embodiment of the present invention.

In another embodiment, a pin-disc assembly may be used to secure a fiber roll or a fiber roll sleeve. For example, referring to FIGS. 20A through 20C, a pin-disc assembly 300 may include a circular disc-shaped structure 301 with a center opening 302 that accepts a metal pin 303 with a thin pointed end and a larger head at the opposite end. The disc-shaped structure may be formed from a flat plate with a larger outer diameter in proportion to its central hole, such as fender washer or a fender-style washer.

The disc-shaped structure also has a fastening area where the string or twine may be attached. Here, the disc shaped structure includes a punch out with a crimp 304 around which the string 305 may be inserted. Alternatively, the disc can include an opening through which one or more strings may be tied in a knot. In a preferred embodiment, the string may be secured to the disc shaped structure without the use of a separate mechanical device, such as a screw or rivet. The string has two loose ends of sufficient length to wrap around the outside surface of a fiber roll, securing the roll in place.

As a non-limiting example, the disc-shaped structure may be formed from a lightweight sheet metal disc, such as a metal fender-style washer with a diameter of approximately 1 inch. The metal pin can be a standard pin measuring approximately 9/16 inches in diameter and 6 inches in length. The string may measure approximately 36 to 42 inches in length.

Figure 21B:
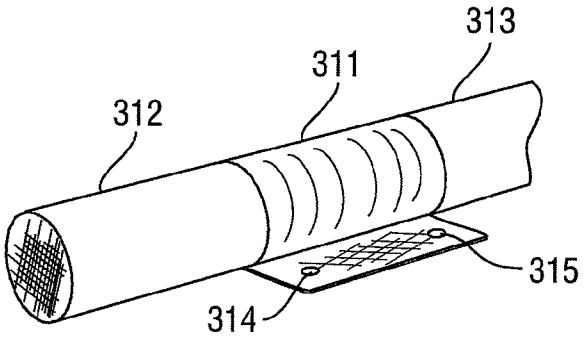
FIG. 21B illustrates a perspective view of a pin-disc assembly used with a fiber roll sleeve, in accordance with another embodiment of the present invention.
Figure 21A:
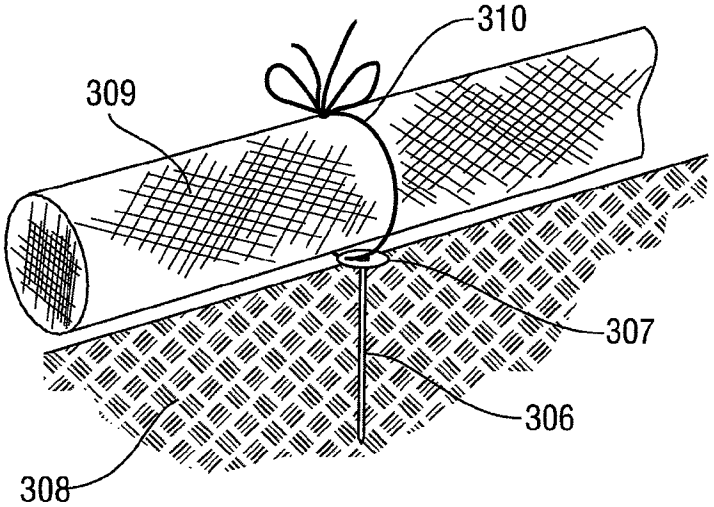
FIG. 21A illustrates a perspective view of a pin-disc assembly with a fiber roll, installed above a ground surface.

The pin-disc assembly may be secured to the ground and attached to a fiber roll, for example at a construction site. As illustrated in FIG. 21A, the pin 306 may be inserted through the center opening of the disc structure 307 and driven into the ground 308. A fiber roll 309 is placed above the pin-disc assembly, and the string 310 from the assembly is wrapped around an outside surface of the fiber roll to secure the fiber roll to the ground. Multiple pin-disc assemblies may also be used to secure the fiber roll. As shown in this embodiment, the fiber roll can be relatively easily secured to the ground without the need to drive a conventional stake through the entire fiber roll. Because the pin does not protrude above the top of the fiber roll, this pin-disc assembly also eliminates potential safety hazards accompanying the use of conventional stakes to secure fiber rolls.

In another embodiment, the pin-disc assembly described above may be used without string to install a sleeve around a fiber roll. As shown in FIG. 21B, a sleeve 311 (such as one of those described in Section I, above) may be used with adjacent fiber rolls 312 and 313. Pins 314 and 315 may be driven through the apron portion of the sleeve, through the disc (not shown), and into the ground. The pin-disc assembly may also be used any fiber rolls that have an apron portion, such as a burlap encased fiber roll with an apron.

The present invention also provides other types of anchoring assemblies for securing fiber rolls to the ground. In one embodiment, a tapered base member is designed for placement in the ground. One or more attachment members is disposed along an upper portion of the base member to securing the fiber roll. The base member is driven through the ground or other surface on which the fiber roll is to rest. The attachment member is attached to a fiber roll; for example, by wrapping and tying the attachment member around the outer surface of the fiber roll. In this way, the fiber roll is also secured to the ground or surface.

Figure 22:
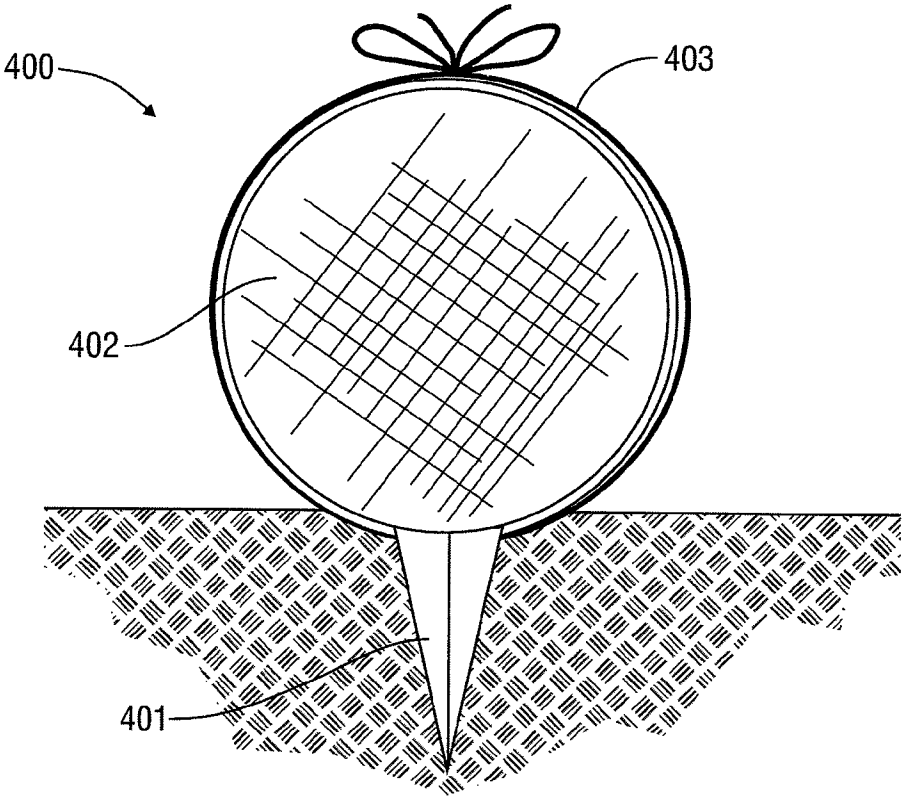
FIG. 22 illustrates a cross-sectional side view of an anchoring assembly secured around a fiber roll in accordance with one embodiment of the present invention.

Referring to FIG. 22 an exemplary anchoring assembly is secured around a fiber roll. The anchoring assembly 400 includes a spike 401 that is driven down through the ground surface beneath the fiber roll 402. One or more pieces of twine or string 403 attached to an upper portion of the spike is wrapped around an outside surface of the fiber roll, thus securing the fiber roll to the ground.

Figure 23B:
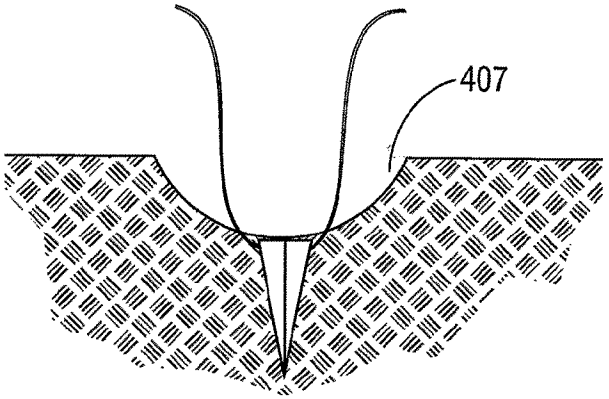
FIG. 23B illustrates a side view of the assembly of FIG. 23A, installed along a ground surface.
Figure 23C:
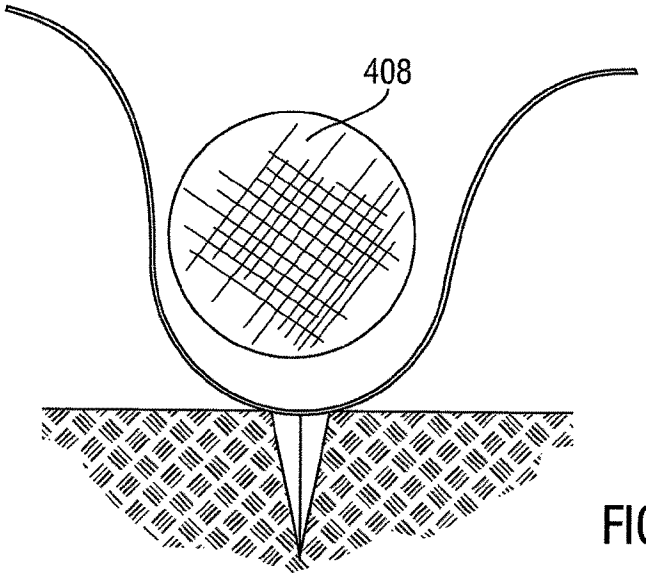
FIG. 23C illustrates a side view of the assembly of FIG. 23A, also installed along a ground surface. The string wraps around a fiber roll placed above the assembly.
Figure 23A:
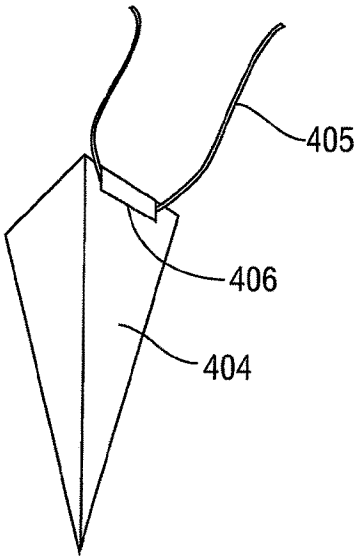
FIG. 23A illustrates a perspective view of an anchoring assembly with a string attached to a side surface of a spike, in accordance with one embodiment of the present invention.

FIG. 23A illustrates an anchoring assembly with a string attached to an upper side portion of the spike. In this embodiment, the spike 404 is in the shape of an inverted pyramid, with a wide top that tapers to a sharp point at the bottom of the spike to facilitate entry of the spike into the ground. The top has a top surface on which the fiber roll can rest. A piece of string 405 is attached to the spike along an upper side portion of the spike. Here, the spike also includes a protrusion or a tab 406 that may be crimped over the string. The string has two loose ends of sufficient length to be wrapped and tied around the outside surface of a fiber roll, securing the roll in place.

As a non-limiting example, in one embodiment, the spike may be approximately 6 inches high. It may have a substantially square cross-section that is approximately 0.75 inches long and 0.75 inches wide along the uppermost surface. The string may measure approximately 36 to 42 inches in length. The string may be attached to a metal spike formed from 22-gauge mild steel.

During installation, the spike may be driven into a flat ground surface until the top of the spike is flush or nearly flush with a substantially flat ground surface. Alternatively, the spike may be driven into the bottom of a prepared notch or trench 407, as illustrated in FIG. 23B. A fiber roll 408 is placed above the spike, as depicted in FIG. 23C, until it rests on the top surface of the spike. The loose ends of the string are wrapped around the outer surface of the fiber roll. The ends of the string are secured around the fiber roll via tying or other methods known in the art for attaching strings to fiber rolls (e.g., clips, hooks, or other fasteners).

Figure 24B:
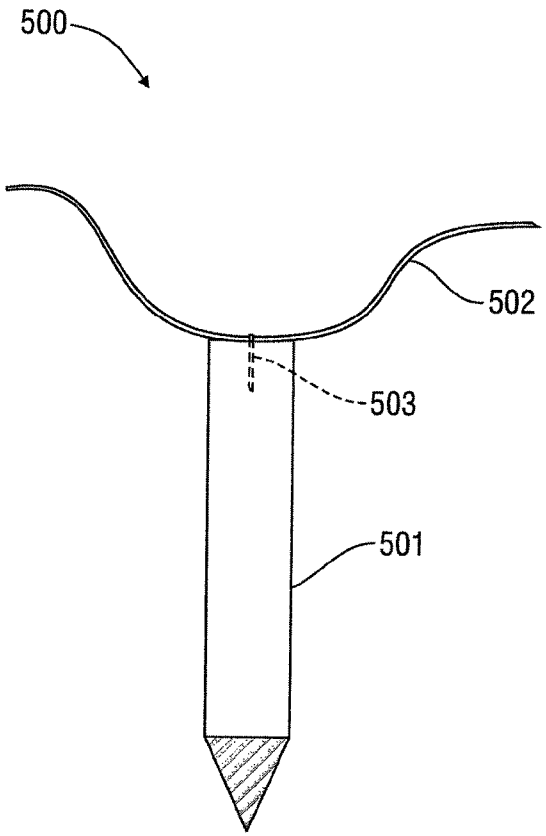
FIGS. 24A and 24B illustrates perspective and side views, respectively, of an anchoring assembly with a wood stake and string attached to a top surface of the stake, in accordance with one embodiment of the present invention.
Figure 24A:
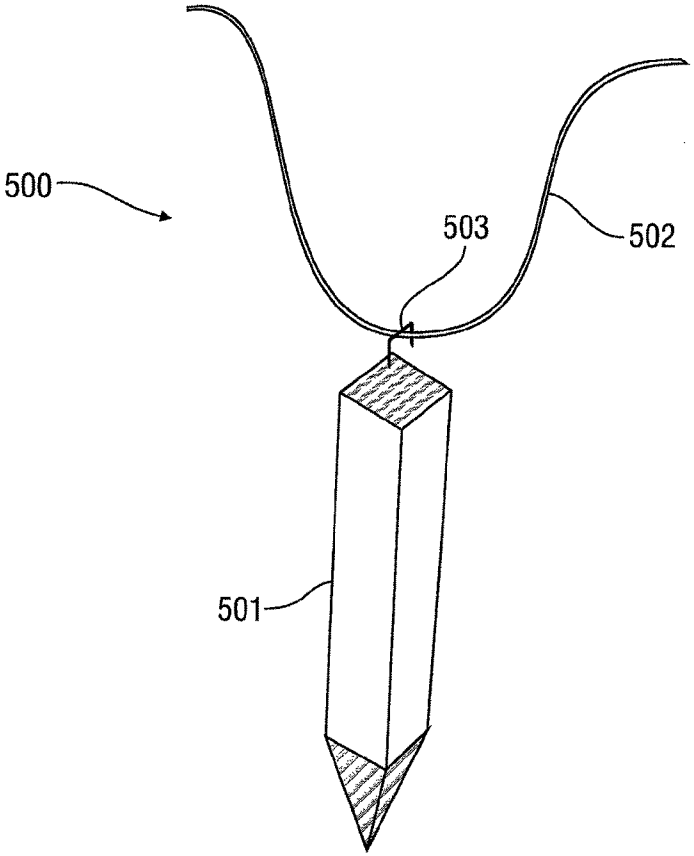

In another embodiment, a wooden stake may be used to secure the fiber roll to a ground surface. Referring to FIGS. 24A and 24B, a stake assembly 500 includes a wood stake 501. The upper portion of the wood stake has a substantially rectangular cross-section and a substantially flat, rectangular top surface. Its lower portion tapers to a sharp point to facilitate entry of the stake into the ground. Twine or string 502 is stapled to a top of the wood stake using one or more staples 503. The stake is driven into the ground beneath a fiber roll, and the string is tied around the fiber roll, securing the fiber roll in place. This method may be particularly desirable for use with biodegradable wattles, as the wooden stakes are not exposed above the fiber roll and may be left in place after construction of the area is complete.

Figure 25:
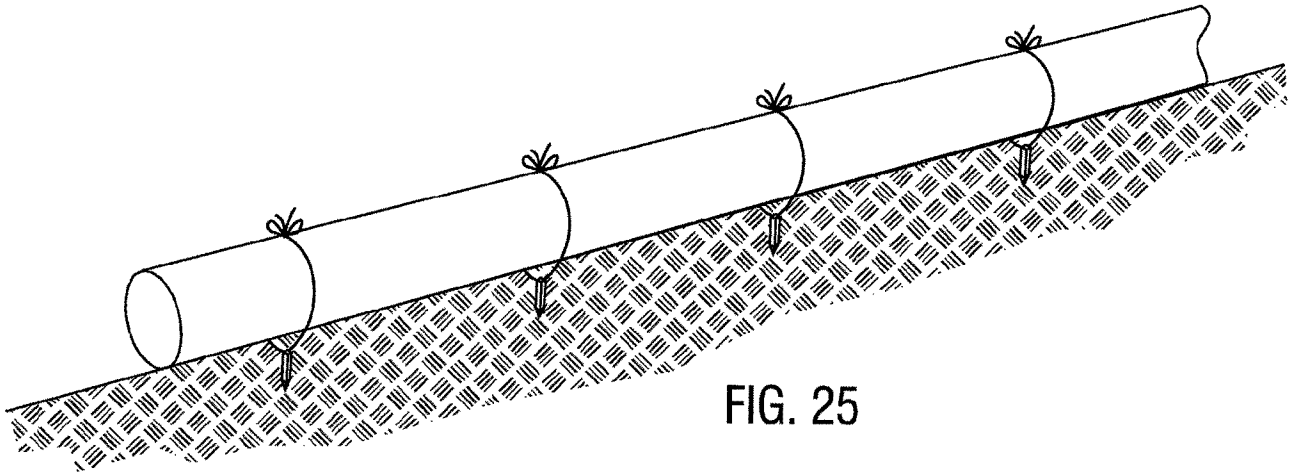
FIG. 25 illustrates a perspective view of an installation of an anchoring assembly in accordance with one embodiment of the present invention.

It may be appreciated that multiple anchoring assemblies of the present invention may be used with a fiber roll or a row of fiber rolls in different combinations and using different methods for securing the fiber rolls to the ground. For example, as shown in FIG. 25, a fiber roll may be tied down using discrete stake assemblies. Here, multiple stake assemblies are placed on the same side (e.g., the underside) of one or more fiber rolls. The string from each stake assembly wraps around the fiber roll. Then an end of the string is tied to the other end of the string from the same stake assembly, in a "wrap-around" configuration.

Figure 26:
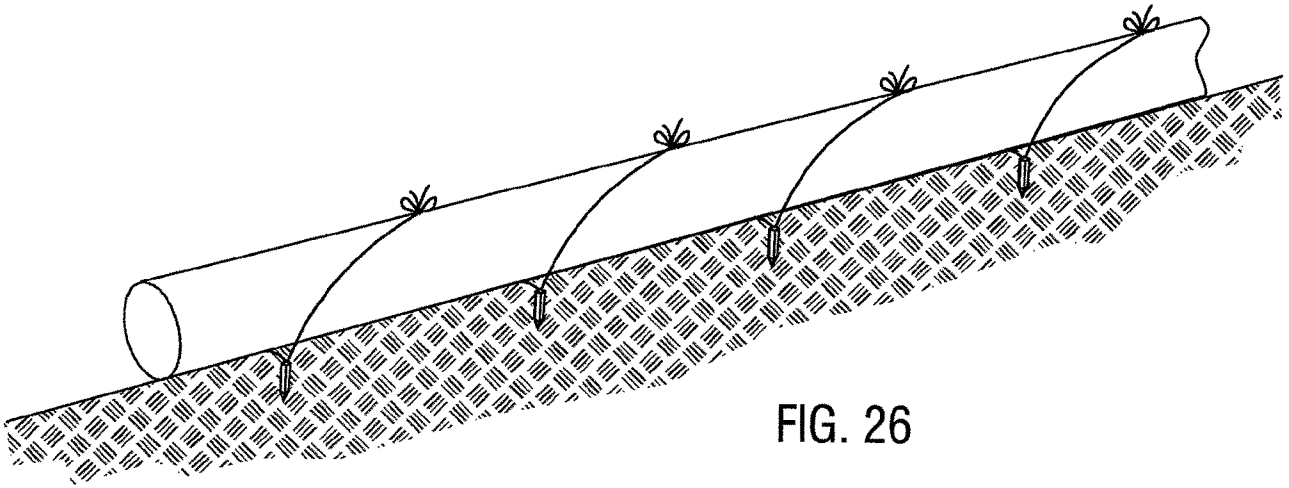
FIG. 26 illustrates a perspective view of an alternate installation of an anchoring assembly in accordance with another embodiment of the present invention.

In another exemplary embodiment, shown in FIG. 26, strings from different stake assemblies may be interconnected. That is, stake assemblies are placed on alternating side of one or more fiber rolls. A string from one stake assembly wraps diagonally around the fiber roll. Then an end of that string is tied to another end of the string from an adjacent stake assembly, in a "linear tie-down" configuration.

The shapes, dimensions, and materials of the base and attachment members described above (e.g., stakes, pins-disc, and pin assemblies) are provided for illustrative purposes, however, and they are not intended to limit the scope of the invention.

It will be appreciated that the anchoring assemblies of the present invention may be used in various combinations with the fiber roll members described in this application, standard fiber rolls, or fiber roll components known in the art. Moreover, these are merely illustrative examples of the various anchoring assemblies in some embodiments of the invention. The anchoring assembly of the present invention may be attached to a fiber roll using different types of base members (or a combination of different base members) known in the art for securing fiber rolls to a ground or other surface may be used to help stabilize the fiber rolls, including the apron portions of a fiber roll, to the ground. They include, without limitation, one or more spikes, stakes, pins, nails, cones, inverted pyramids, rods, pipes, poles, post, or base structures with substantially cylindrical, rectangular, circular, or oval shaped components.

The ordinary artisan will also recognize that the shape of the base member, its dimensions, and the materials used to construct the pin can be varied based on a range of design options available; e.g., materials, erosion control application, structural requirements, site specifications, ease of construction, and the sizes and types of fiber rolls used with the sleeve. For example, a substantially cylindrical spike or stake may be used, as may one with substantially curved or rounded edges.

In addition, the skilled artisan will recognize that the anchoring assemblies described above may be attached to one or more fiber rolls using a wide range of different attachment members (or a combination of attachment members) known in the art to flexibly and effectively secure materials to fiber rolls; including without limitation, attaching the base portion to the fiber rolls using one of more of the following: cotton, hemp, or other material twisted together to form a thin length, other types of string, thread, cord, rope, staples, drawstrings, fasteners, snaps, hooks, glue, pins, nails, bolts, screws, clips, hinges, or other fastening devices. In some embodiment, an attachment member may be one or more removable components, separate from the base member. In other embodiments, an attachment member may be integrated with the base member to form a unitary structure.

The skilled artisan will also recognize that the base member may include a wide range of features for securing the attachment member. For example, in addition to the configurations described above, the anchoring assembly many include a string attachment within a formed or cut notch in the base member (e.g., a formed or cut notch in a wooden stake). The anchoring assembly may alternatively include a hoop shaped staple with a string attachment. The anchoring assembly may also include a nail or pin with twine directly attached. The anchoring assembly may include a screw or bolt that secures the attachment member.

Further, it is contemplated that the shapes and dimensions described throughout this application are provided for illustrative purposes. They are not intended to limit the scope of the invention. The ordinary artisan will recognize that the shape of the anchoring assembly, including the base members and attachment members, and its dimensions can be varied based on a range of design options available; e.g., materials, erosion control application, site specifications, overall system and site configuration, ease of construction, dimensions of the fiber rolls, dimensions of the site or sloped surface, desired water flow capacity, desired weight, desired amount of water flow to be managed, and the size and structure of the overall erosion control system in which the components are used.

It is also contemplated that the materials useful for the anchoring assemblies of the present invention can vary within a range dependent on one or more design factors including but not limited to: desired weight, ability to be secured to a fiber roll, durability, structural stability, strength, and climate resistance. In various embodiments of the present invention, materials useful for construction of the base member include but are not limited to: 22-gauge mild steel, wood, polypropylene, or any other materials that provide can support for fiber rolls and/or effectively secure erosion control and/or sediment control devices.

In some embodiments, the components of the present invention may be used as part of a temporary installation. For example, the anchoring assemblies described above may be used during construction of a site and removed after construction is complete. In other embodiments, the components of the present invention may be used as part of a permanent installation. For example, the anchoring assemblies described above may be made of biodegradable materials that can be used with burlap wattles and left in place in a landscaped area.

While possible configurations and structural shapes are shown in the figures, it is within the scope and contemplation of the invention to use the assemblies with fiber rolls and systems in other shapes (e.g., fiber rolls with substantially rectangular cross-sections, block-shaped, substantially cylindrical, or substantially circular fiber rolls) using different couplings, fasteners, and shapes.

In addition, as known by those of skill in the art, the dimensions of the anchoring assemblies, and the sizes of the openings, may vary to accommodate different design considerations, such as different widths, circumferences, lengths, and heights (outside and inside dimensions), desired weights for each attachment member. The ordinary artisan also will recognize that the absolute dimension of the holes, slots, and openings can be selected to accept industry standard components, connections, and/or fittings.

The anchoring systems of the present invention may be designed for placement in different combinations and in different areas of a fiber roll. For example, the assembly may be designed to be used with a tubular fiber roll (or fiber roll sleeve) along the body portion, at end segments, or at a middle segment, away from the end segments. Multiple anchoring assemblies may be used with a single fiber roll, or the anchoring assemblies may be used as a system to anchor multiple fiber rolls.

The above disclosures are sufficient to enable one of ordinary skill in the art to practice the invention, and provide the best mode of practicing the invention presently contemplated by the inventor. While there is provided herein a full and complete disclosure of specific embodiments of this invention, it is not desired to limit the invention to the exact construction, dimensional relationships, and operation shown and described. Various modifications, alternative constructions, design options, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

What is claimed is:

1. A method of controlling soil erosion along a slope comprising the steps of:

(a) positioning a fiber roll member along an area; the fiber roll member comprising: an elongated body member comprising two flexible side pieces, complementary closures disposed along a portion of each of the side pieces of the body member, and a fastener disposed along an interior of the body member;

(b) positioning a fiber roll over the fiber roll member, (c) connecting the body member to the fiber roll using the fastener;

(d) fitting the side pieces of the body member around an outer surface of the fiber roll; and (e) connecting the side pieces of the body member using the complementary closures.

2. The method of claim 1, wherein the complementary closures on the side pieces of the body member comprise a mechanical closure selected from the group consisting of a hook-and-loop fastener, string, a snap, a staple, and a zipper.

3. The method of claim 1, wherein the fastener disposed along an interior of the body member comprises a tie-down string.

4. The method of claim 1, wherein the elongated body member is adapted to fit around an end portion of a first fiber roll and an end portion of a second fiber roll to couple the fiber rolls.

5. The method of claim 1, wherein the fiber roll member further comprises an apron member.

6. The method of claim 5, further comprising the step of securing the apron member to a surface using one or more installation pins.

7. The method of claim 5, wherein the fiber roll member further comprises a plurality of apron members.

8. The method of claim 1, wherein the elongated body member comprises an interior space, and the interior space is adapted to define a substantially tubular opening.

9. The method of claim 1, wherein the elongated body member is constructed of biodegradable burlap material.

10. The method of claim 1, wherein the elongated body member is constructed of UV degradable polypropylene material.

11. The method of claim 1, wherein the elongated body member comprises a high visibility color.

12. The method of claim 1, wherein the elongated body member is adapted to fit around a segment of a single fiber roll.

13. The method of claim 1, wherein the elongated body member is adapted to be positioned at intervals along joints of a fiber roll assembly.

14. The method of claim 1, wherein the step of (a) positioning a fiber roll member comprises securing an installation pin through a hoop disposed along an exterior portion of the elongated body member.

15. The method of claim 14, wherein the fastener and hoop comprise a unitary structure.

16. The method of claim 14, wherein the installation pin comprises a hooked-structure selected from the group consisting of a pin with a U-shaped hook, a pin with a triangle-shaped hook, and a pin with a diamond-shaped hook.

17. The method of claim 1, further comprising reflective material disposed along a length of the body member.

* * * * *